US006799351B2

(12) United States Patent
Porath

(10) Patent No.: US 6,799,351 B2
(45) Date of Patent: Oct. 5, 2004

(54) FLOATING NOZZLE

(75) Inventor: Steven H. Porath, Painesville, OH (US)

(73) Assignee: HMI Industries, Inc., Seven Hills, OH (US)

( * ) Notice: Subject to any disclaimer, the term of this patent is extended or adjusted under 35 U.S.C. 154(b) by 240 days.

(21) Appl. No.: 10/112,828

(22) Filed: Mar. 29, 2002

(65) Prior Publication Data

US 2003/0182752 A1 Oct. 2, 2003

(51) Int. Cl.[7] ..... A47L 5/00; A47L 9/04

(52) U.S. Cl. ..... 15/377; 15/325; 15/415.1; 15/359

(58) Field of Search ..... 15/246.2, 300.1, 15/325, 415.1, 422, 354, 359, 363, 377, 378, 391; D32/21

(56) References Cited

U.S. PATENT DOCUMENTS

| | | | | |
|---|---|---|---|---|
| 1,228,176 A | | 5/1917 | Bishop | |
| 1,782,882 A | | 11/1930 | Rippey | |
| 2,348,861 A | | 5/1944 | Smellie | |
| 2,798,243 A | | 7/1957 | Wex | |
| 2,893,048 A | | 7/1959 | Martinec | |
| 2,980,939 A | * | 4/1961 | Sparklin et al. | 15/377 |
| 3,071,799 A | * | 1/1963 | Jepson et al. | 15/354 |
| 3,205,528 A | | 9/1965 | Fromknecht et al. | |
| 3,310,828 A | * | 3/1967 | Clark et al. | 15/328 |
| 3,343,344 A | | 9/1967 | Fairaizl et al. | |
| 3,354,496 A | | 11/1967 | Jonsson | |
| 3,668,734 A | | 6/1972 | Fairaizl et al. | |
| 3,685,089 A | | 8/1972 | Lagerstrom | |
| 3,694,848 A | | 10/1972 | Alcala | |
| 3,722,024 A | | 3/1973 | Schmitz | |
| 3,733,646 A | | 5/1973 | Mein | |
| 3,744,082 A | | 7/1973 | Marshall | |
| 3,783,474 A | | 1/1974 | Fairaizl et al. | |
| 3,818,540 A | | 6/1974 | Martinec et al. | |

(List continued on next page.)

FOREIGN PATENT DOCUMENTS

JP 06-54780 * 1/1994

OTHER PUBLICATIONS

U.S. application Ser. No. 09/809,841, filed Mar. 19, 2001.

*Primary Examiner*—Robert J. Warden, Sr.
*Assistant Examiner*—Laura C Cole
(74) *Attorney, Agent, or Firm*—Fay, Sharpe, Fagan, Minnich & McKee

(57) ABSTRACT

A power nozzle for use with a vacuum cleaner. The power nozzle includes a housing having at least two compartments and a bottom surface, a rotary brush at least partially in a front compartment of the housing, a brush motor at least partially positioned in an back compartment of the housing, a suction opening located in the bottom surface of the housing, a set of front wheels, a set of rear wheels, and a wand connected to the housing. The bottom surface has a front end, a back end, and a non-planar shape. The bottom surface at least partially slopes downwardly at least between the front end of the bottom surface and the set of front wheels.

79 Claims, 12 Drawing Sheets

U.S. PATENT DOCUMENTS

| | | | | |
|---|---|---|---|---|
| 3,936,903 | A | | 2/1976 | Johnson |
| 3,936,905 | A | | 2/1976 | Stewart et al. |
| 3,942,216 | A | | 3/1976 | Minton |
| 3,942,219 | A | | 3/1976 | Johnson |
| 4,023,234 | A | | 5/1977 | Martinec et al. |
| 4,199,839 | A | | 4/1980 | Martinec |
| 4,507,819 | A | | 4/1985 | Martinec |
| 5,248,323 | A | | 9/1993 | Stevenson |
| 5,515,573 | A | | 5/1996 | Frey |
| 5,593,479 | A | | 1/1997 | Frey et al. |
| 5,603,741 | A | | 2/1997 | Frey |
| 5,641,343 | A | | 6/1997 | Frey |
| 5,651,811 | A | | 7/1997 | Frey et al. |
| 5,658,362 | A | | 8/1997 | Frey |
| 5,837,020 | A | | 11/1998 | Cartellone |
| 5,840,103 | A | | 11/1998 | Dyson |
| 6,010,550 | A | | 1/2000 | Song |
| 6,090,184 | A | | 7/2000 | Cartellone |
| D432,746 | S | | 10/2000 | Frey |
| 6,197,096 | B1 | | 3/2001 | Cartellone |
| 6,553,599 | B2 | * | 4/2003 | Paterson et al. ..... 15/378 |
| 2001/0003853 | A1 | * | 6/2001 | Fukuoka et al. ..... 15/346 |

* cited by examiner

FLOATING NOZZLE

The present invention relates to the art of air filter systems and, more particularly, to an improved vacuum cleaner employing a novel power nozzle. The invention is particularly applicable for a canister-type vacuum cleaner and will be described with particular reference thereto; however, the invention has much broader applications and may be used in other types of vacuum cleaners.

INCORPORATION BY REFERENCE

U.S. Pat. Nos. 3,343,344; 3,668,734; 3,783,474; 3,818,540; 4,023,234; 4,199,839; 4,507,819; 5,248,323; 5,515,573; 5,593,479; 5,603,741; 5,651,811; 5,658,362; 5,840,103; 6,010,550; 6,090,184; 6,197,096; and Des. No. 432,746, and U.S. patent application Ser. No. 09/809,841 filed Mar. 19, 2001 are incorporated herein as background information regarding the type of vacuum cleaning systems to which the present invention is particularly applicable, and to preclude the necessity of repeating structural details relating to such cleaning systems. Several of these patents and the patent application illustrate canister-type vacuum cleaners having a low velocity receptacle or chamber into which is placed a filter sheet placed over a downwardly extending support structure for the purpose of removing particulate material from the air flowing through the vacuum cleaner. The structure or member holds the filter sheet in its configuration. Within the conical support member there is typically provided a filter sheet for further removal of particulate solids as the solids pass with the air from the canister through the filter and through the filter sheet to the outlet or exhaust of the vacuum cleaner.

U.S. Pat. Nos. 4,023,234; 4,199,839; and 4,507,819 are incorporated herein as background information regarding power nozzles to which the present invention is particularly applicable, and to preclude the necessity of repeating structural details relating to such power nozzles.

BACKGROUND OF THE INVENTION

As more people populate urban environments, there is an increasing need to provide a clean air environment at home and in the workplace. In urban areas, where pollution levels sometimes exceed maximum values set by the EPA, the need for a clean air environment becomes even more apparent. In view of the hazards these polluted environments pose, the public has demanded a means for removing pollutants from the environment to provide a healthy environment for both living and working. Furthermore, many particles in the air can act as irritants and/or increase or aggravate a person's allergies. Airborne pollutants can also contribute to respiratory infections and/or illnesses which can be discomforting and/or hazardous to individuals with respiratory problems. Particles in the air can also create problems such as burning eyes, nose and/or throat irritation; cause or contribute to headaches and dizziness; and/or cause and/or contribute to coughing and sneezing. Furthermore, these particles can include various types of spores, dust mites, microorganisms (e.g., bacteria, viruses, etc), allergens, and/or other types of harmful particles which may cause illness and/or infection to a person; and/or induce and/or aggravate respiratory ailments (asthma, RSV, lung cancer, etc.).

In an effort to reduce the number of particles in the air and/or other environments, many homes, offices, and buildings have incorporated a central filtering system to remove particles entrained in the air. Unfortunately, these systems are very expensive and/or do not remove many of the small particles which can be the most hazardous and/or irritable to persons (e.g., spores, allergens (e.g., pollen, smoke, etc.), micro-organisms (e.g. bacteria, viruses, etc.), dust mites, asbestos, metals, harmful and/or irritating chemicals, etc.). Typically, these filtering systems only remove about 300,000 particles out of about 20 million particles which flow into the filter medium. The small particles, which make up a majority of the particles in the air, freely pass through these conventional filter systems and are recirculated through the home and/or office.

In an effort to remove particles from a home and/or office environment, and reduce the amount of particles recirculated during the vacuuming of the home and/or office, two design strategies have been developed by Assignee, one relating to the design of the vacuum cleaner and the second relating to the design of the filters. Assignee has found that canister-type vacuum cleaners provide superior cleaning efficiencies as compared with standard upright vacuum cleaners. One particular canister-type vacuum cleaner is illustrated in U.S. Pat. No. 5,248,323, which is incorporated herein by reference. The canister-type vacuum cleaner includes a reduced or low velocity chamber with a high velocity air inlet. Air is drawn into the low velocity chamber by an electric motor which drives a rotary fan. The rotary fan creates a vacuum in the low velocity chamber to draw air laden with particulate material through the chamber and to blow the filtered air through an outlet in the motor housing as exhausted cleaned air. Canister-type vacuum cleaners normally include a cylindrical or a conical cellulose filter extending downwardly into the canister or low velocity chamber. The filter is typically formed of a porous mat to remove dirt and debris carried by the air drawing into the low velocity chamber. The high velocity air drawn into the chamber has entrained large solid particles. The large particles which are brought into the low velocity chamber are swirled or vortexed in a centrifuge configuration with convolutions so that the large particles are extracted by the vortex or cyclonic action of the air in the canister. Thereafter, the air is pulled through the filter toward an upper motor that drives a fan which creates a vacuum in the canister or low velocity chamber. The fan then expels the filtered air outwardly through an exhaust passage, or passages, above the canister. A filter, such as a thin filter disc, is typically provided between the conical filter and the fan to at least partially prevent large particulate material that is inadvertently passed through the cylindrical or conical filter from contacting the fan. The '323 patent discloses the use of an activated charcoal containing filter to efficiently remove gaseous impurities in the air, such as, but not limited to, paint fumes and other odor creating gases.

The canister-type vacuum cleaner, as so far described, though exhibiting improved cleaning efficiencies as compared with standard upright vacuum cleaners, only removed relatively large particles entrained in the air. Many of the air particles of a size less than 10 microns passed freely through the filter medium and were recirculated in the room. These small particles can act as irritants to an individual and the recirculation of such particles can increase such irritation to an individual. High density filters can be used to filter out these very small particles in the air; however, high density filters cause large pressure drops through the filter and thus cannot be cost effectively used in standard vacuum cleaners.

The filter system disclosed in U.S. Pat. Nos. 5,593,479; 5,651,811; and 6,090,184 addressed the problem of filtering small particles. The filter was a specialized filter developed to remove many of the small particles in the air. Such filters are known as High Efficiency Particle Air Filters, or HEPA filters, which, by government standards, are filters with a minimum efficiency of 99.97%.

Recently, Assignee developed a new vacuum cleaner that effectively and efficiently removes particles entrained in the air. This new vacuum cleaner is disclosed in Assignee's U.S. patent application Ser. No. 09/809,841 filed Mar. 19, 2001. In the '841 patent application, a novel filter arrangement and vacuum cleaner design were disclosed which further improved the filtering efficiencies of the vacuum cleaner. In addition, the '841 patent application disclosed a unique vacuum cleaner design that facilitated in the removal and/or replacement of the filter from the vacuum cleaner. Assignee's United States patent application Ser. No. 09/809,841 filed Mar. 19, 2001 is incorporated herein by reference. In a later filed patent application by Assignee, U.S. patent application Ser. No. filed, a novel filter liner was disclosed for use in vacuum cleaners. Assignee's United States Patent Application Serial No. filed is incorporated herein by reference. The filter liner was designed to minimize particle release from the vacuum cleaner and filter when the vacuum cleaner filter was changed.

Even though Assignee has addressed and overcome many of the problems associated with past canister-type vacuum cleaners with respect to the ease and efficiency of removing the majority of particles from the air entering the vacuum cleaner, there remains a need for an improved cleaning nozzle that can effectively and efficiently remove dirt and other particles from a variety of different surfaces. Prior art power nozzles such as illustrated in U.S. Pat. Nos. 3,818,540 and 4,023,234 include a main nozzle housing member formed of molded plastic material. The main housing member typically included a generally rectangular cup-shaped form with integral top, end, front and back walls. The main housing member was closed with a metal housing bottom plate which was removable from the main housing member for gaining access to several compartments formed by the bottom plate and the main cup-shaped member and partitions extending from the top wall of the cup-shaped member. One of these compartments formed a nozzle mouth in which a power driven rotary brush was located. The partitions extending from the top wall of the cup-shaped housing member to the removable bottom plate also formed a main suction passage or duct communicating between the nozzle mouth and a tubular connector for the wand. The other compartment contained the brush drive motor, the drive belt, the supporting wheels, and the wheel adjusting mechanism.

The power nozzles disclosed in U.S. Pat. Nos. 3,818,540 and 4,023,234 were very effective in removing dirt and other particles from a floor when used in association with a canister-type vacuum cleaner; however, such power nozzles did not properly seal against air flow between the compartments of the power nozzle. Thus, such power nozzles sometimes encountered problems relating to lint which collected in various compartments in the nozzle housing. Such lint buildup adversely affected the operation of the power nozzle and/or the vacuum cleaner. Assignee addressed these problems by designing an improved power nozzle disclosed in U.S. Pat. No. 4,199,839. The improved power nozzle had a power driven rotary brush mounted within the nozzle housing, a housing bottom plate formed with a nozzle inlet opening adjacent the rotary brush, adjustable nozzle supporting wheels located within the housing and projecting through openings in the bottom plate, a wheel height adjusting mechanism located within the nozzle housing, a motor located in the nozzle housing for driving the rotary brush, and suction passages in the housing leading from the nozzle opening to a tubular connector which was detachably connected with the lower end of a wand, which wand could also carry an electrical supply cord to supply power to the rotary brush motor. The lint problem in the improved nozzle was overcome by providing a housing having two separate compartments, one of which houses the nozzle brush drive motor, and the other of which houses adjusting mechanisms for nozzle support wheels. The power nozzle limited the lint problems associated with past nozzle designs, and further provided a nozzle with supporting wheels, some of which extended through openings in the nozzle housing bottom plate and were adjustable, and which also were provided with a wheel height adjusting mechanism located within the nozzle housing in a compartment separate from that of the brush motor. The improved nozzle, by limiting lint problems, reduced lint buildup in the power nozzle and airflow obstruction through the nozzle, which could cause over-heating of the brush drive and/or the tank unit motors.

Although past power nozzle designs have been effective in cleaning a variety of surfaces, there remains a need for a power nozzle that has improved dirt and particle removal from a floor surface. In addition, there remains a need for a power nozzle that is easy and convenient to use over different types of surfaces.

SUMMARY OF THE INVENTION

The present invention relates to an improved vacuum cleaner and, more particularly, to an improved power nozzle used in association with vacuum cleaner such as, but not limited to, canister-type vacuum cleaners. The present invention also relates to a vacuum cleaner having a filter arrangement which enables the vacuum cleaner to efficiently and effectively at least partially remove particles and/or unwanted odors or gases from a vacuumed surface. The invention is particularly directed to cyclonic-type vacuum cleaners such as, but not limited to, canister-type vacuum cleaners, to handle a wide variety of particles entrained in the air being drawn through the vacuum cleaner; however, other types of vacuum cleaners can be used in association with the improved power nozzle of the present invention. The improved power nozzle is designed to provide improved cleaning and have increased versatility and ease of use over a variety of surfaces.

In accordance with the present invention, there is provided a vacuum cleaner of the type comprising a reduced or low velocity chamber with a high velocity air inlet, a motor, a rotary device driven by the motor to create a vacuum in the low velocity chamber, an outlet for exhausting air from the low velocity chamber, and a filter arrangement positioned at least partially in the low velocity chamber for removing particles from the air. In one embodiment of the invention, the filter arrangement includes one or more changeable and/or disposable filters. In another and/or alternative embodiment of the invention, at least one of the filters of the filter arrangement at least partially removes particles. In one aspect of this embodiment, the filter arrangement removes a majority particles. Such a filter provides significantly cleaner filtered air. In one aspect of this embodiment, over 90% of the particles greater than about 2 microns in size are filtered out of the air passing through the improved filter arrangement. In yet another and/or alternative embodiment of the invention, the filter arrangement includes mechanical, electrical (which includes electrostatic) and/or chemical mechanisms to filter out the particles. In still yet another and/or alternative embodiment of the invention, the filter arrangement is designed to at least partially remove odors from the air such as, but not limited to, smoke, fumes, gas contaminants, and/or noxious gases. In one aspect of this embodiment, the filter arrangement incorporates the use of one or more gas absorbing and/or adsorbing substances to absorb and/or adsorb odors that are drawn into the vacuum cleaner or other type of air cleaner. In a still yet another and/or alternative aspect of this embodiment, at least one gas filter and the least one particle filter are oriented such that the at least one particle filter or filter layer filters particles prior to exposing the filtered air to the at least one gas filter. In a further and/or alternative aspect of this embodiment, at least one gas filter and at least one particle filter are oriented such that the at least one gas filter or gas filter layer absorbs and/or adsorbs gas prior to exposing the gas filtered air to the at least one particle filter. In still a further and/or alternative aspect of this embodiment, at least one gas filter both filters particles and gases from the air as the air passes through the gas filter. In a further and/or alternative embodiment of the invention, at least one particle filter of the filter arrangement is made of one or more filter layers. In one aspect of this embodiment, at least one particle filter is a single filter made of multiple filter layers. In another and/or alternative aspect of this embodiment, at least one particle filter is a plurality of single layer filters. In still another and/or alternative aspect of this embodiment, at least one particle filter is a plurality of filters, which filters are single layer filters and/or multiple layer filters. If more than one layer is used, the layer can be connected together by a variety of means such as, but not limited to, adhesives, stitching, staples, clamps, melted regions, and/or the like. In still a further and/or alternative embodiment, at least one particle filter at least partially removes particles from the air mechanically, chemically and/or electrically. In another and/or alternative embodiment of the invention, at least one particle and/or gas filter is pliable so that the filter can easily conform to and/or deform on a surface such as, but not limited to, when the filter is subjected to suction. In one aspect of this embodiment, the deformation the filter at least partially results in the filter having one or more ribs and/or one or more recessed sections between the ribs. In still yet another and/or alternative embodiment of the invention, the particle and/or gas filter is substantially rigid so that the filter substantially does not deform when subjected to suction. In still another and/or alternative embodiment, the particle and/or gas filter is at least partially cylindrical, conical or semi-conical in shape to increase the surface area of the one or more filter, thereby providing increased particle removal efficiency. As can be appreciated, one or more filters can have a variety of other shapes such as, but not limited to, disk-shaped, square-shaped, rectangular-shaped, oval-shaped, etc. In yet a further and/or alternative embodiment, the composition, shape, structure, and/or position of at least one filter includes, but is not limited to, the composition, shape, structure, operation, and/or position of one or more filters disclosed in U.S. Pat. Nos. 5,248,323; 5,593,479; 5,641,343; 5,651,811; 5,837,020 and 6,090,184; and U.S. patent application Ser. No. 09/809,841 filed Mar. 19, 2001, which are incorporated herein by reference. In still yet a further and/or alternative embodiment, the configuration or design of at least one filter includes, but is not limited to, the configuration or design disclosed in U.S. Pat. Nos. 5,248,323; 5,593,479; 5,641,343; 5,651,811; 5,837,020; 6,010,550; 6,090,184; and 6,197,096; and U.S. patent application Ser. No. 09/809,841 filed Mar. 19, 2001, which are incorporated herein by reference.

In accordance with still yet another and/or alternative aspect of the present invention, a support mechanism is employed to maintain one or more of the filters of the filter arrangement in a proper position in the vacuum cleaner and/or to support the one or more filters during the filtration of the air. The support mechanism can be incorporated into the filters themselves and/or can be an external mechanism, such as a frame. In one embodiment of the invention, the composition, shape, structure, and/or position of the support mechanism is at least similar to, but is not limited to, the composition, shape, structure, operation, and/or position of the support mechanism disclosed in U.S. Pat. Nos. 5,248,323; 5,593,479; 5,641,343; 5,651,811; 6,010,550; 6,090,184; 6,197,096; and U.S. patent application Ser. No. 09/809,841 filed Mar. 19, 2001, which are incorporated herein by reference.

In accordance with still a further and/or alternative aspect of the invention, the filter arrangement includes a safety filter to at least partially prevent large particles from entering the motor section of the vacuum cleaner and/or contacting the motor fan. During the operation of the vacuum cleaner, one or more particle filters may be damaged or become damaged during use of the vacuum cleaner and/or from improper installation. In one embodiment of the invention, the composition, shape, structure, and/or position of the safety filter is at least similar to, but is not limited to, the composition, shape, structure, operation, and/or position of the safety filter disclosed in U.S. Pat. Nos. 5,248,323; 5,593,479; 5,641,343; 5,651,811; 6,010,550; 6,090,184; 6,197,096; and U.S. patent application Ser. No. 09/809,841 filed Mar. 19, 2001, which are incorporated herein by reference.

In accordance with yet a further and/or alternative aspect of the invention, the filter arrangement includes a post exhaust gas filter. The post exhaust gas filter is designed to at least partially remove undesired gases and/or odors such as, but not limited to, smoke, fumes, gas contaminants, and/or noxious gases from the filtered air after the filtered air exits the motor section of the vacuum cleaner. In one embodiment of the invention, the composition, shape, structure, and/or position of the post exhaust filter is at least similar to, but is not limited to, the composition, shape, structure, operation, and/or position of the post exhaust filter disclosed in U.S. patent application Ser. No. 09/809,841 filed Mar. 19, 2001, which is incorporated herein by reference.

In accordance with still yet a further and/or alternative aspect of the invention, the filter arrangement includes a post exhaust air freshener. The post exhaust air freshener is designed to emit pleasant odors in the air exiting the vacuum cleaner. In one embodiment of the invention, the composition, shape, structure, and/or position of the post exhaust freshener is at least similar to, but is not limited to, the composition, shape, structure, operation, and/or position of the post exhaust freshener disclosed in U.S. patent application Ser. No. 09/809,841 filed Mar. 19, 2001, which is incorporated herein by reference.

In accordance with another and/or alternative aspect of the present invention, the vacuum cleaner includes a filter arrangement. The filter liner arrangement includes a filter liner to enable more convenient disposal of particles that have fallen to the base or bottom of the low velocity chamber. In one embodiment of the invention, the composition, shape, structure, and/or position of the filter liner is at least similar to, but is not limited to, the composition, shape, structure, operation, and/or position of the filter liner disclosed in United States Patent Application Serial No. filed, which is incorporated herein by reference.

In accordance with a further and/or alternative aspect of the present invention, the vacuum cleaner includes a removable canister to facilitate in the convenient disposal of dust and/or debris collected in the low velocity chamber. In one embodiment of the invention, the shape, structure, and/or position of the removable canister is at least similar to, but is not limited to, the shape, structure, operation, and/or position of the removable canister disclosed in U.S. patent application Ser. No. 09/809,841 filed Mar. 19, 2001, which is incorporated herein by reference.

In accordance with still a further and/or alternative aspect of the invention, the low velocity chamber of the vacuum cleaner includes an inlet nozzle that directs particle containing air about the filters in the low velocity chamber. The inlet nozzle, in effect, facilitates in the cyclonic air paths in the low velocity chamber. In one embodiment of the invention, the shape, structure, and/or position of the air inlet is at least similar to, but is not limited to, the shape, structure, operation, and/or position of the air inlet disclosed in U.S. patent application Ser. No. 09/809,841 filed Mar. 19, 2001, which is incorporated herein by reference.

In accordance with yet a further and/or alternative aspect of the invention, the vacuum cleaner includes an air exhaust that increases the efficiency of air flow through the vacuum cleaner. In one embodiment of the invention, the shape, structure, and/or position of the air exhaust is at least similar to, but is not limited to, the shape, structure, operation, and/or position of the air exhaust disclosed in U.S. patent application Ser. No. 09/809,841 filed Mar. 19, 2001, which is incorporated herein by reference.

In accordance with still yet a further and/or alternative aspect of the invention, the vacuum cleaner includes a power nozzle construction in which nozzle chamber and airflow passage lint collection, which may cause over-heating of brush drive and tank unit motors, is substantially eliminated. In one embodiment of the invention, the power nozzle includes a housing formed with two separate compartments, one of which houses the nozzle brush drive motor, and the other of which houses a rotary brush. In another and/or alternative embodiment of the invention, the power nozzle includes three housing members that are releaseably assembled with simple accessible connecting means to form the nozzle housing and the two described compartments. In still another and/or alternative embodiment of the invention, the power nozzle includes a housing design for ready replacement of the upper outer housing member without dismantling the remaining housing members or components in the housing compartments. In yet another and/or alternative embodiment of the invention, the power nozzle includes a primary housing member, an auxiliary housing member, and a housing bottom plate member which form the nozzle housing, and connectors to connect the bottom plate and primary housing member. In one aspect of this embodiment, the primary housing is located intermediate of the auxiliary and bottom plate members. In another and/or alternative aspect of this embodiment, the primary and auxiliary housing members, when assembled, have walls forming a back compartment between the primary and auxiliary housing members and a front compartment between the primary housing member and bottom plate. In one non-limiting design, a rotary brush is journaled in the front compartment. In another and/or alternative non-limiting design, a brush drive motor is mounted in the back compartment and a drive belt is connected to the drive motor and rotary brush.

In accordance with still yet a further and/or alternative aspect of the invention, the power nozzle includes a modified bottom surface to increase the air flow through the power nozzle. The increased air flow through the power nozzle results in increased suction by the power nozzle which in turn increases the amount of dirt and other particles drawn into the power nozzle as the power nozzle passes over a surface. As a result, improved cleaning efficiencies are realized by the use of the improved power nozzle. In one embodiment, at least a portion of the bottom suction opening in the power nozzle is positioned closer to a floor surface than other portions of the bottom surface of the power nozzle. This novel positioning of the suction opening results in an increase in air velocity about the suction opening. This air velocity increase has been found to increase the cleaning efficiency of the power nozzle as the power nozzle is moved over a floor surface. The raised front end of the power nozzle also facilitates in increased air flow under the power nozzle. In one aspect of this embodiment, the bottom surface of the power nozzle slopes downwardly from the front of the bottom surface to the suction opening. The slope can be a linear and/or curved slope. In one non-limiting design, the downward slope is substantially uniform. In another non-limiting design, the downward slope is not substantially uniform. In still another and/or alternative non-limiting design, the downward slope begins at the front end of the bottom surface of the power nozzle. In yet another and/or alternative non-limiting design, the downward slope begins at a point spaced from the front end of the bottom surface of the power nozzle. In still yet another and/or alternative non-limiting design, the downward slope terminates at a point before the front wheel of the power nozzle. In still yet another and/or alternative non-limiting design, the downward slope terminates at a point before the back end of the suction opening. In a further and/or alternative non-limiting design, the downward slope terminates at the suction opening. In still a further and/or alternative non-limiting design, the downward slope terminates at a point spaced from the suction opening. In another and/or alternative aspect of this embodiment, the bottom surface of the power nozzle slopes downwardly from at least one side of the bottom surface to the suction opening. The slope can be a linear and/or curved slope. In one non-limiting design, the downward slope is substantially uniform. In another non-limiting design, the downward slope is not substantially uniform. In still another and/or alternative non-limiting design, the downward slope begins at the end of at least one side of the bottom surface of the power nozzle. In yet another and/or alternative non-limiting design, the downward slope begins at a point spaced from at least one side of the bottom surface of the power nozzle. In still yet another and/or alternative non-limiting design, the downward slope terminates at the suction opening. In a further and/or alternative non-limiting design, the downward slope terminates at a point spaced from the suction opening. In yet another and/or alternative aspect of this embodiment, the bottom surface of the power nozzle slopes upwardly from the suction opening to the rear end of the bottom surface of the power nozzle. The slope can be a linear and/or curved slope. In one non-limiting design, the upward slope is substantially uniform. In another non-limiting design, the upward slope is not substantially uniform. In still another and/or alternative non-limiting design, the upward slope begins at a point spaced from the front end of the suction opening. In yet another and/or alternative non-limiting design, the upward slope begins at the suction opening. In still yet another and/or alternative non-limiting design, the upward slope begins at a point spaced from the suction opening. In a further and/or alternative non-limiting design, the upward slope terminates at the back end of the bottom surface. In still a further and/or alternative non-limiting design, the upward slope terminates at a point spaced from the back end of the bottom surface. In still yet another and/or alternative aspect of this embodiment, the bottom surface of the power nozzle that is positioned rearwardly of the suction opening remains substantially level with a floor surface. In a further another and/or alternative aspect of this embodiment, the bottom surface of the power nozzle includes at least one air channel to at least partially alter the flow of the air as the air flows along the bottom surface of the power nozzle. The one or more air channels can be used to at least partially control the air flow along the bottom of the power nozzle to facilitate in increasing the cleaning effectiveness of the power nozzle and/or increase the amount of suction through the power nozzle. In one aspect of this embodiment, at least one air channel is at least partially formed by a groove in the bottom surface of the power nozzle. In another and/or alternative aspect of this embodiment, at least one air channel is at least partially formed by at least one rib in the bottom surface of the power nozzle.

In accordance with still yet a further and/or alternative aspect of the invention, the power nozzle includes a dirt guard that inhibits or prevents dirt and/or air particles from being swept into the suction opening by the rotating brush at least partially in or closely adjacent to the suction opening. The rotating brush is designed to agitate a floor surface to at least partially cause dirt and/or other particles on the floor surface to be captured by the air being drawn into the suction opening. The brush generally includes bristles and/or sweeper blades to agitate the floor surface. During the rotation of the rotating brush, the bristles and/or sweeper blades can also cause dirt and/or other particles to be thrown into the suction opening. However, the bristles and/or sweeper blades can alternatively cause dirt and/or other particles to be thrown rearwardly of the suction opening. The dirt guard is designed to inhibit or prevent such dirt and/or air particles from being thrown rearwardly of the power nozzle. The dirt guard is at least partially designed to act as a barrier to such dirt and/or air particles. Dirt and/or other particles stopped by the dirt guard may later be redrawn into the suction opening and into the vacuum cleaner. In one embodiment, the dirt guard is a blade, felt, and/or a plurality of bristles positioned rearwardly of the suction opening. In one aspect of this embodiment, the dirt guard is made of a flexible material. In one non-limiting embodiment, the dirt guard includes a material such as, but not limited to, plastic, synthetic materials (e.g. nylon, polyester, polypropylene, synthetic rubber, etc.), natural materials (e.g. cotton, wool, wood, rubber, etc.), and/or the like. In another and/or alternative aspect of this embodiment, the dirt guard at least extends the full width of the suction opening. In still another and/or alternative aspect of this embodiment, the dirt guard extends a partial width of the suction opening. In another and/or alternative embodiment, the dirt guard is positioned parallel with or forward of the front wheels of the power nozzle. In still another and/or alternative embodiment, the dirt guard is positioned rearwardly of the front wheels of the power nozzle.

In accordance with another and/or alternative aspect of the invention, the power nozzle includes a brush switch that activates and deactivates the rotating brush. On certain floor surfaces such as, but not limited to, carpet, the rotating brush improves the cleaning effectiveness of the vacuum cleaner. On other surfaces such as, but not limited to, wood floors, the rotating brush does not substantially provide the cleaning effectiveness of the vacuum cleaner. As such, the use of the brush wastes energy, furthers the wear of the bristles and/or blades of the rotating brush, and/or may cause scratches on a polished surface. The brush switch can also be used to deactivate the brush motor when an article gets stuck and/or entangled with the rotating brush. The shutting off of the motor reduces the chance of damage to the motor, rotating brush and/or other components (e.g. belt) associated with the rotating brush. In one embodiment of the invention, the brush switch is located on the handle of the power nozzle. In still another and/or alternative embodiment, a safety switch is provided to automatically disable the rotating brush when the power nozzle is turned on its side and/or upside down. The safety switch is designed to inhibit or prevent damage and/or injury to and object and/or individual. In one aspect of this embodiment, the safety switch reactivates the connection between the brush switch and brush motor when the power nozzle is properly positioned on a floor surface.

In accordance with still another and/or alternative aspect of the invention, the power nozzle includes a rotating brush that is rotated by a cog belt. The cog belt reduces the incidence of slip during the operation of the rotating brush.

In accordance with yet another and/or alternative aspect of the invention, the power nozzle includes a brush motor that causes the rotation of the rotating brush in the power nozzle. In one embodiment of the invention, the brush motor can be designed to cause a single rotation speed for the rotating brush, or cause multiple rotation speeds for the rotating brush. In another and/or alternative embodiment of the invention, the brush motor can be designed to cause additional suction through the power nozzle. In one aspect of this embodiment, a blade is connected to the brush motor and provides additional suction within the power nozzle during operation of the brush motor.

In accordance with still yet another and/or alternative aspect of the invention, the power nozzle includes a front set of wheels that is positioned such that the front wheel axle and/or axis of rotation is positioned from the front edge of the power nozzle a distance that is at least half the distance between the front and back edge of the power nozzle. Such positioning of the front wheels results in at least about half of the bottom surface of the power nozzle being unsupported as the power nozzle is moved over a floor surface. In prior power nozzle designs, the front set of wheels were positioned such that the front wheel axle and/or axis of rotation was positioned from the front edge of the power nozzle a distance that was less than half the distance between the front and back edges of the power nozzle. The novel positioning of the front wheels of the power nozzle in combination with the novel contour of the bottom results in a floating effect of the front end of the power nozzle. The air flow under the power nozzle results in a lifting effect that allows the front of the power nozzle to ride on a layer of air. This lifting or floating effect makes it easier for the power nozzle to be moved over various types of floor surfaces. The air flow into and under the bottom of the power nozzle has also been found to improve the amount of cleaning from the sides of the power nozzle, thus edge sweeping by the power nozzle is improved. As a result, the power nozzle has a larger cleaning footprint than prior power nozzles. Consequently, the need for side air inlets to clean areas adjacent the side edge of the power nozzle are not required. As can be appreciated, side air inlets could be used if desired. In one embodiment of the invention, the front set of wheels is positioned such that the front wheel axle and/or axis of rotation is positioned from the front edge of the power nozzle a distance that is over half the distance between the front and back edges of the power nozzle. In one aspect of this embodiment, the front set of wheels is positioned such that the front wheel axle and/or axis of rotation is positioned from the front edge of the power nozzle a distance that is at least about 51% of the distance between the front and back edges of the power nozzle. In another and/or alternative aspect of this embodiment, the front set of wheels is positioned such that the front wheel axle and/or axis of rotation is positioned from the front edge of the power nozzle a distance that is at least about 55% of the distance between the front and back edges of the power nozzle. In still another and/or alternative aspect of this embodiment, the front set of wheels is positioned such that the front wheel axle and/or axis of rotation is positioned from the front edge of the power nozzle a distance that is at least about 60% of the distance between the front and back edges of the power nozzle. In yet another and/or alternative aspect of this embodiment, the front set of wheels is positioned such that the front wheel axle and/or axis of rotation is positioned from the front edge of the power nozzle a distance that is at least about 65% of the distance between the front and back edges of the power nozzle. In still yet another and/or alternative aspect of this embodiment, the front set of wheels and the rear set of wheels are positioned such that the distance between the front wheel axle and/or axis of rotation and the rear wheel axle and/or axis of rotation is less than about 50% of the distance between the front and back edges of the power nozzle. In a further and/or alternative aspect of this embodiment, the front set of wheels and the rear set of wheels are positioned such that the distance between the front wheel axle and/or axis of rotation and the rear wheel axle and/or axis of rotation is less than about 55% of the distance between the front and back edges of the power nozzle. In still a further and/or alternative aspect of this embodiment, the front set of wheels and the rear set of wheels are positioned such that the distance between the front wheel axle and/or axis of rotation and the rear wheel axle and/or axis of rotation is less than about 60% of the distance between the front and back edges of the power nozzle. In yet a further and/or alternative aspect of this embodiment, the front set of wheels and the rear set of wheels are positioned such that the distance between the front wheel axle and/or axis of rotation and the rear wheel axle and/or axis of rotation is less than about 65% of the distance between the front and back edges of the power nozzle. In still yet a further another and/or alternative aspect of this embodiment, the front set of wheels and the rear set of wheels are positioned such that the distance between the front wheel axle and/or axis of rotation and the rear wheel axle and/or axis of rotation is less than about 68% of the distance between the front and back edges of the power nozzle. In still another and/or alternative embodiment of the invention, the majority of the weight of the power nozzle is positioned rearwardly of the front wheels of the power nozzle. This weight distribution of the power nozzle facilitates in the floating effect of the front of the power nozzle during operation. In one aspect of this embodiment, the brush motor is positioned rearwardly of the front wheels of the power nozzle. In yet another and/or alternative embodiment of the invention, the rotating brush is positioned in the base of the power nozzle such that the brush inhibits or prevents the front end of the power nozzle from contacting a hard floor surface (e.g. wood floor, tile floor, etc.). During normal operation of the power nozzle, the air flowing under the bottom of the power nozzle causes the front of the power nozzle to be lifted, thereby enabling easier movement of the power nozzle over a variety of surfaces. Periodically, the user may encounter an obstruction in a floor surface (e.g., floor crack, small toys, uneven floor surface, etc.). Such obstructions may inhibit or prevent the front wheels from moving past the obstruction, thereby causing the front of the power nozzle to pivot downwardly toward the floor surface. The rotating brush, whether or not rotating, inhibits or prevents the front end of the power nozzle from contacting the floor surface, thereby reducing or preventing any damage that may be caused to the front of the power nozzle and/or floor surface. In still yet another and/or alternative embodiment of the invention, the front wheels of the power nozzle are not adjustable in height. In prior power nozzle designs, the front wheels were adjustable in order to adjust the height of the front end of the power nozzle to enable the power nozzle to be used on different surfaces. For instance, the front wheels were lowered to cause the front end of the power nozzle to be raised to enable the power nozzle to be used on rugs or carpets. The front wheels were raised to cause the front end of the power nozzle to be lowered to enable the power nozzle to be used on flat surfaces (e.g., wood, linoleum, tile, brick, concrete, etc.). The power nozzle of the present invention does not require the adjustment of the front wheels for use of the power nozzle on different surfaces. The position of the front wheels is set so as to maintain the proper angle and height of the power nozzle on most surfaces. Consequently, the guess work associated with selecting the proper adjustment height is eliminated by the power nozzle of the present invention. In a further and/or alternative embodiment of the invention, the rear wheels of the power nozzle are large in order to facilitate movement of the power nozzle over a variety of surfaces. In one aspect of this embodiment, the rear wheels have a larger diameter than the front wheels.

In accordance with a further and/or alternative aspect of the invention, the power nozzle includes at least one side opening to facilitate in cleaning regions along the side of the power nozzle.

In accordance with a further and/or alternative aspect of the invention, the power nozzle includes a bumper guard that is positioned at least partially about the outer perimeter of the power nozzle to inhibit or prevent scratches or damage to walls, furniture, and the like, during the use of the power nozzle. In one embodiment of the invention, the bumper is made of a material that includes plastic, rubber, and/or the like.

In accordance with still a further and/or alternative aspect of the invention, the power nozzle includes a light to at least partially illuminate an area in front of the power nozzle. The light facilitates in exposing to a user soiled or dirty regions on the floor surface so that the user is less likely to miss such regions during cleaning. The light may also illuminate objects on the floor surface that should be removed prior to cleaning the surface with the power nozzle.

In accordance with yet a further and/or alternative aspect of the invention, the power nozzle includes a screen positioned at least partially over the suction opening in the power nozzle. The screen is designed to inhibit or prevent certain light weight objects from being drawn into the suction opening. Such objects can include, but are not limited to, sheets, quilts, blankets, towels, curtains, pillows, small rugs, and the like. The screen enables an operator to move the power nozzle over such objects without causing such objects to be come stuck or clogged in the power nozzle. As a result, a user can use the power nozzle on a bed or futon, over a small area rug, etc. without concern for damage to the power nozzle and/or object being cleaned. In one embodiment of the invention, the screen is designed to be detachably connected to the bottom of the power nozzle. As such, the screen can be easily removed or inserted when needed. In another and/or alternative embodiment of the invention, the screen is non-detachably connected to the power nozzle.

In accordance with yet a further and/or alternative aspect of the invention, the power nozzle includes a motor filter to filter air that enters the brush motor chamber to cool the brush motor during operation. The motor filter facilitates in reducing the number of particles that are redistributed into the air while using the power nozzle. During the operation of the power nozzle, some settled particles reenter the air and can be drawn into the brush motor chamber and then expelled into the area being cleaned. Such particles can cause irritation to an operator. The motor filter is designed to at least partially remove such particles from the air. In one embodiment of the invention, the motor filter filters air entering the brush motor chamber. In another and/or alternative embodiment of the invention, the motor filter filters air leaving the brush motor chamber. In still another and/or alternative embodiment of the invention, the motor filter is a HEPA filter.

The primary object of the present invention is the provision a novel power nozzle that can be used with a vacuum cleaner, which power nozzle provides improved cleaning of a floor surface.

Another and/or alternative object of the present invention is the provision of a novel power nozzle having improved suction.

Still another and/or alternative object of the present invention is the provision of a novel power nozzle having a sloped bottom surface.

Yet another and/or alternative object of the present invention is the provision of a novel power nozzle having non-adjustable front wheels.

Still yet another and/or alternative object of the present invention is the provision of a novel power nozzle that is easier to operate.

A further and/or alternative object of the present invention is the provision of a novel power nozzle having a screen to inhibit or prevent light weight materials from being pulled into the power nozzle.

Still a further and/or alternative object of the present invention is the provision of a novel power nozzle wherein the majority of the bottom surface is not supported by wheels.

Yet a further and/or alternative object of the present invention is the provision of a novel power nozzle having a dirt seal to reduce the amount of dirt thrown from the power nozzle.

Still yet a further and/or alternative object of the present invention is the provision of a novel power nozzle having a larger cleaning footprint than standard power nozzles.

Another and/or alternative object of the present invention is the provision of a novel power nozzle having improved air flow under the power nozzle.

Still another and/or alternative object of the present invention is the provision of a novel power nozzle having a safety switch for the brush motor.

Yet another and/or alternative object of the present invention is the provision of a novel power nozzle having brush motor filter.

Still yet another and/or alternative object of the present invention is the provision of a novel power nozzle having less belt slippage between the brush motor and the rotating brush.

A further and/or alternative object of the present invention is the provision of a novel power nozzle having improved edge cleaning.

These and other objects and advantages will become apparent from the following description taken together with the accompanying drawings.

BRIEF DESCRIPTION OF THE DRAWINGS

Reference is now made to the drawings, which illustrate various embodiments that the invention may take in physical form and in certain parts and arrangement of parts wherein.

DESCRIPTION OF THE PREFERRED EMBODIMENTS

Figure 1:
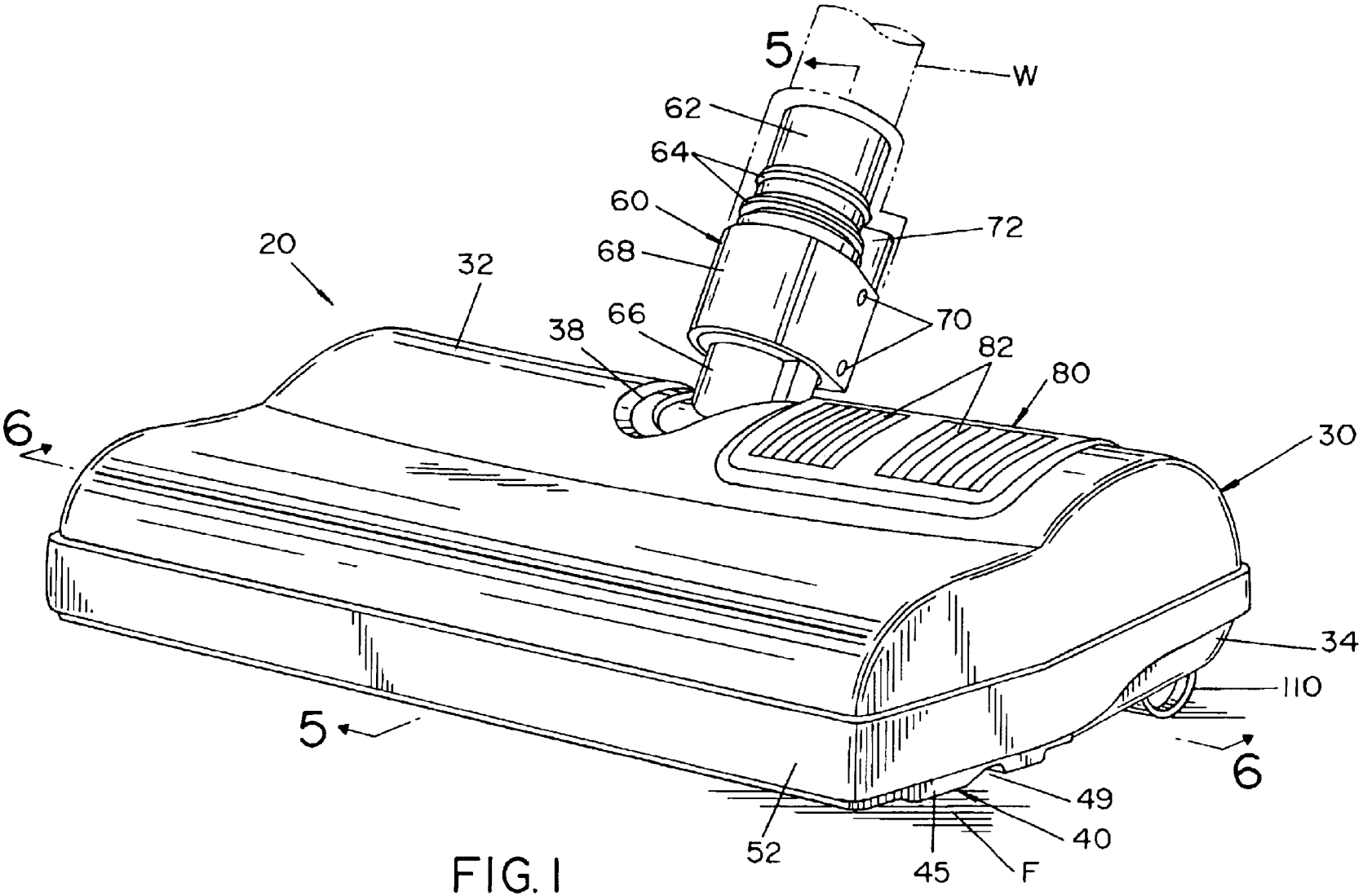
FIG. 1 is a front perspective view of the power nozzle in accordance with the present invention.

Referring now to the drawings wherein the showings are for the purpose of illustrating preferred embodiments of the invention only and not for the purpose of limiting same, FIGS. 1–4 illustrate an improved power nozzle that can be used in association with a vacuum cleaner such as, but not limited to, a canister-type vacuum cleaner. Examples of canister-type vacuum cleaners that can be used with the improved power nozzle are disclosed in U.S. Pat. Nos. 3,343,344; 3,668,734; 3,783,474; 3,818,540; 4,023,234; 4,199,839; 4,507,819; 5,248,323; 5,515,573; 5,593,479; 5,603,741; 5,651,811; 5,658,362; 5,840,103; 6,010,550; 6,090,184; 6,197,096; and Des. No. 432,746, and U.S. patent application Ser. No. 09/809,841 filed Mar. 19, 2001.

Figure 2:
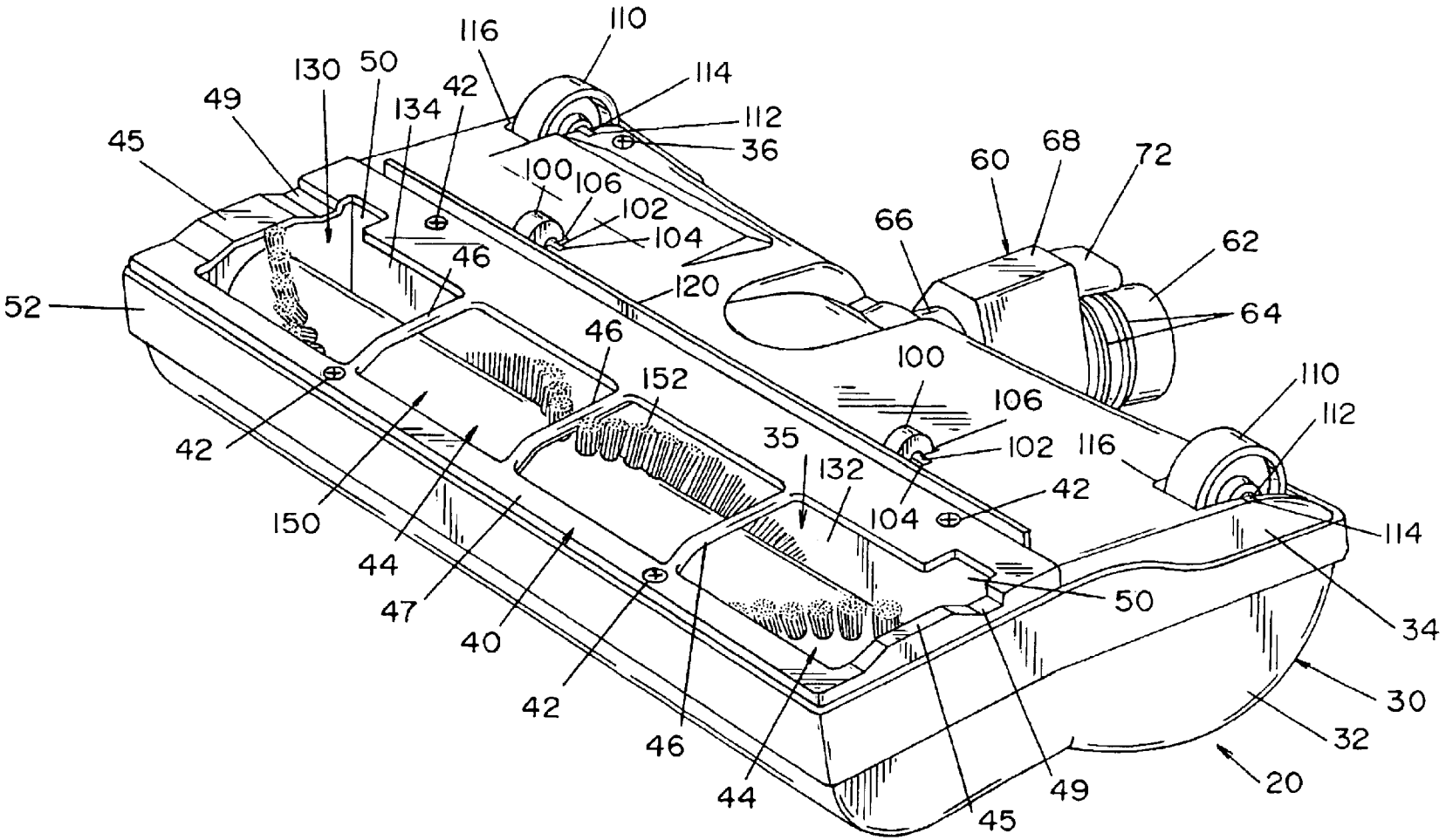
FIG. 2 is a bottom perspective view of the power nozzle shown in FIG. 1.

Referring now to FIGS. 1 and 2, the improved power nozzle 20 includes a housing 30 and a housing bottom plate 40. The housing is typically made of a plastic material; however, other materials can be used. The housing bottom plate is typically made of metal; however, other materials can be used. The housing includes a top portion 32 and a bottom portion 34. The top and bottom portions are connected together by screws 36; however, other mechanisms can be used to connect together the top and bottom portions. Positioned around the perimeter of the side of the housing is a bumper 52. The bumper is typically made of a rubber material; however, other materials can be used. The bumper is designed to minimize damage to the power nozzle and other articles when the power nozzle is used to clean a surface. Generally, the bumper is secured between the top portion 32 and a bottom portion 34 of the housing.

The top portion of the housing 32 includes an opening 38 wherein a movable tubular connector member 60 is positioned therein. The tubular connector member includes an upper extension 62 that has two ribs 64. The upper extension and ribs are designed to secure a metal wand W to the power nozzle so that dirt and other particles can be conveyed from the power nozzle to the vacuum cleaner. Tubular connector member 60 also includes a lower extension 66 which is connected to the upper extension by a coupler 68. The coupler is secured to the upper and lower extensions by bolts 70. The coupler allows for limited rotation of the upper extension with respect to the lower extension. The lower extension is designed to pivot within opening 38 of the housing. The coupler includes an electrical connection 72 and mates with an electrical connector on wand W. The electrical connection is designed to receive electricity for powering the motor in the power nozzle.

Figure 6:
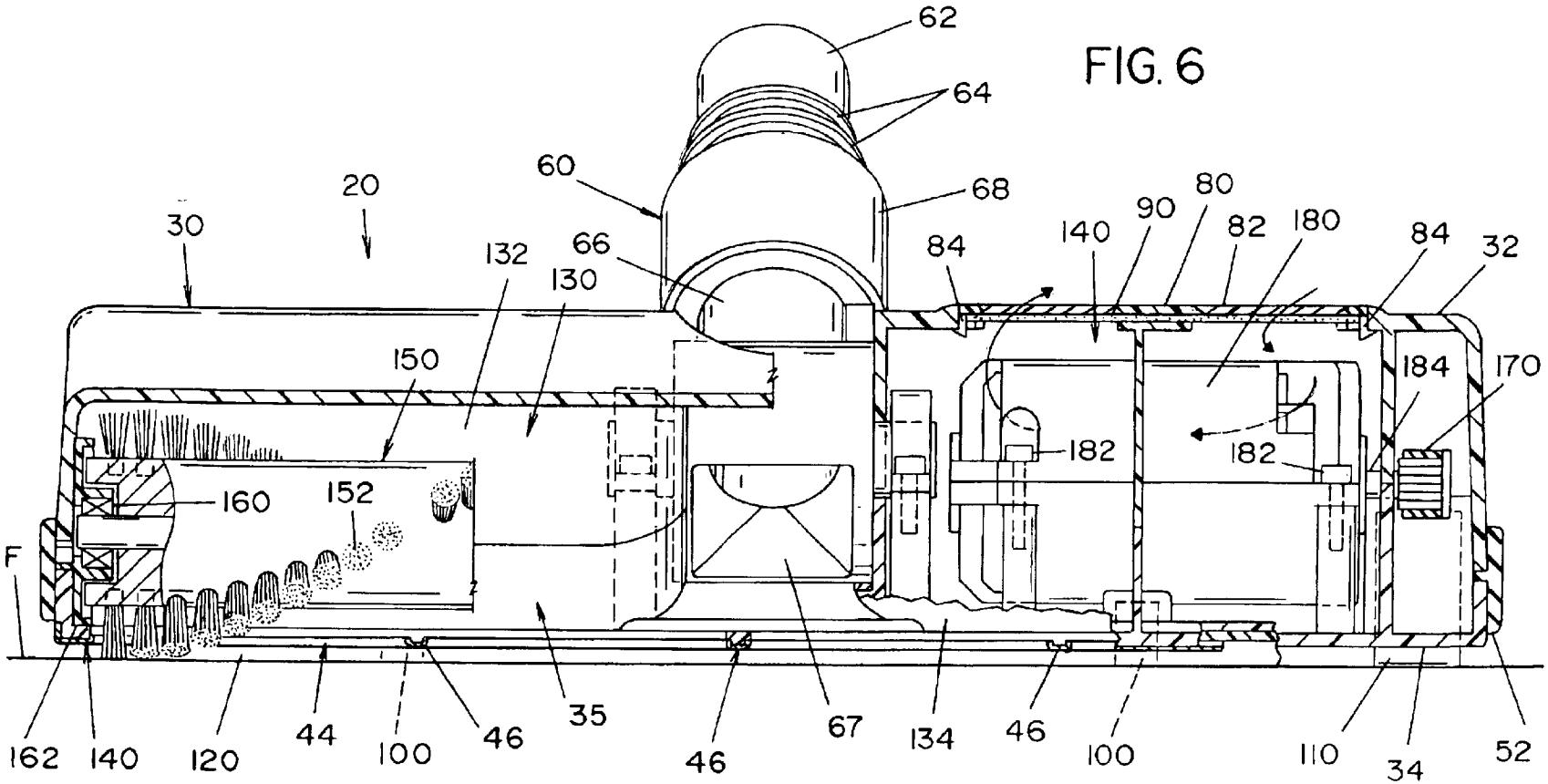
FIG. 6 is a cross-sectional view along line 6—6 of FIG. 1.
Figure 7:
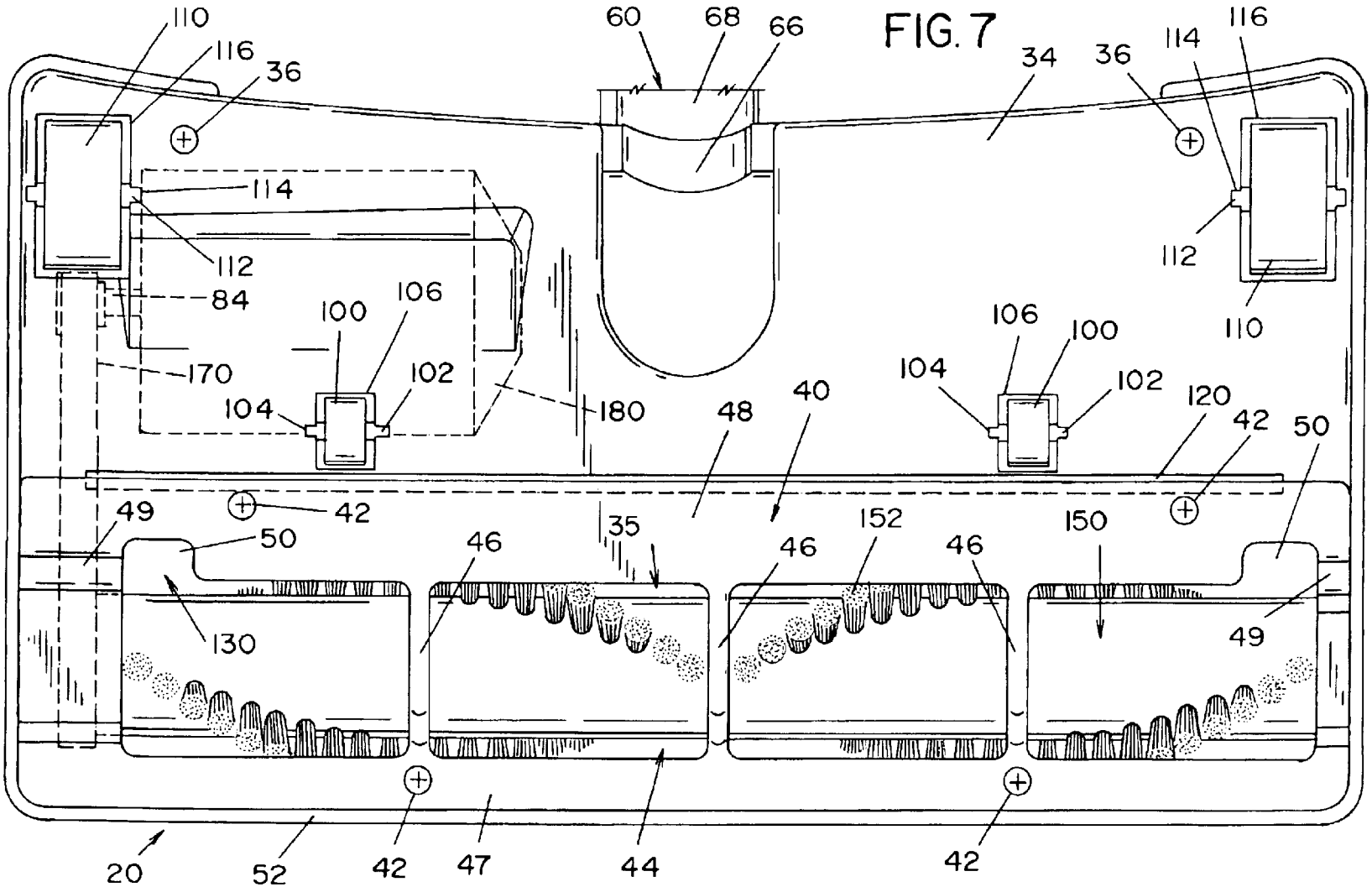
FIG. 7 is a bottom plan view of the power nozzle shown in FIG. 1.

As shown in FIG. 1, the top portion of the housing also includes a plastic grill 80 that allows air to flow into and out of the motor chamber, thereby cooling the motor during operation. The grill includes several slots 82 to allow air to flow through the grill. The grill includes snap hooks 84 that secure the grill to the under side of the top portion of the housing. Referring to FIG. 6, a filter material 90 is positioned beneath the grill. The filter material is designed to filter air that is flowing into and out of the motor chamber.

Referring now to FIG. 2, the bottom portion of the housing includes a set of front wheels 100 and a set of rear wheels 110. Each front wheel is positioned in a wheel cavity 106 in the bottom portion of the housing and rotates about an axle 102 that securely fits in axle slots 104 on the bottom portion of the housing. Similarly, each rear wheel is positioned in a wheel cavity 116 in the bottom portion of the housing and rotates about an axle 112 that securely fits in axle slots 114 on the bottom portion of the housing. Both the front set of wheels and the rear set of wheels are non-adjustable. The rear set of wheels has a larger radius that the front wheels. Typically, the radius of the rear wheels is at least about twice the radius and width of the front wheels. The larger rear wheel radius and width facilitates in the movement of the power nozzle over a variety of surfaces. The rear wheels are also positioned closer to the side of the bottom portion of the housing than the front wheels. Such a wheel positioning also facilitates in the movement of the power nozzle over a variety of surfaces.

Figure 5:
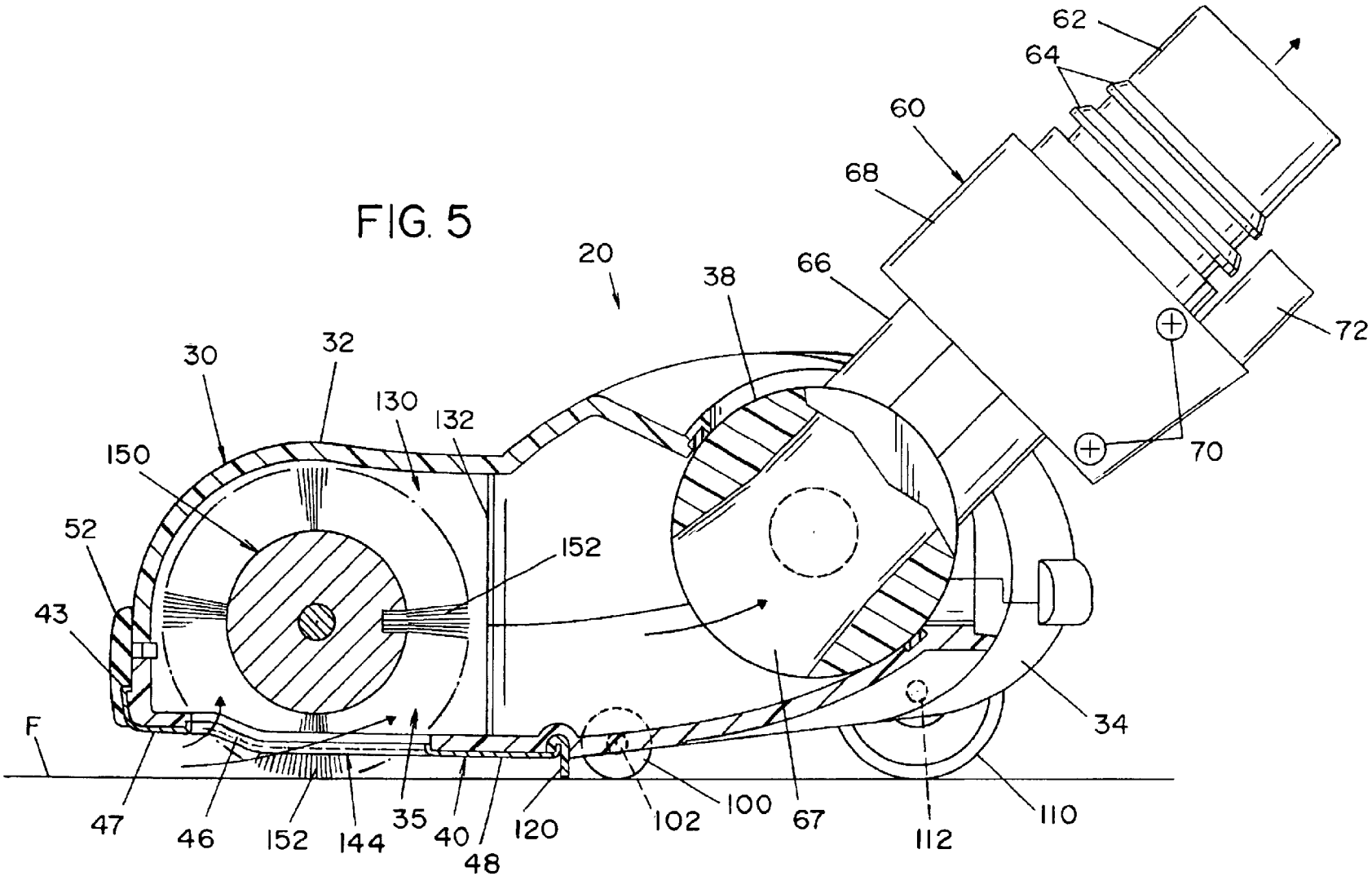
FIG. 5 is a cross-sectional view along line 5—5 of FIG. 1.

Positioned forwardly of the front wheels is a dirt guard 120. As can be appreciated, the dirt guard can be positioned rearwardly of the front wheels. The dirt guard extends substantially the full width of the bottom portion. The dirt guard is mounted to the bottom portion by the bottom plate 40 as shown in FIG. 5. The dirt guard is typically a flexible blade or bristles. The dirt guard inhibits or prevents dirt or other particles from being projected rearwardly of the power nozzle during the operation of the power nozzle. The distance the dirt guard extends from the bottom portion of the housing is typically close to the radial length of the front wheels. Such a length results in the end of the dirt guard being positioned on or closely adjacent to a surface to be cleaned.

Figure 4:
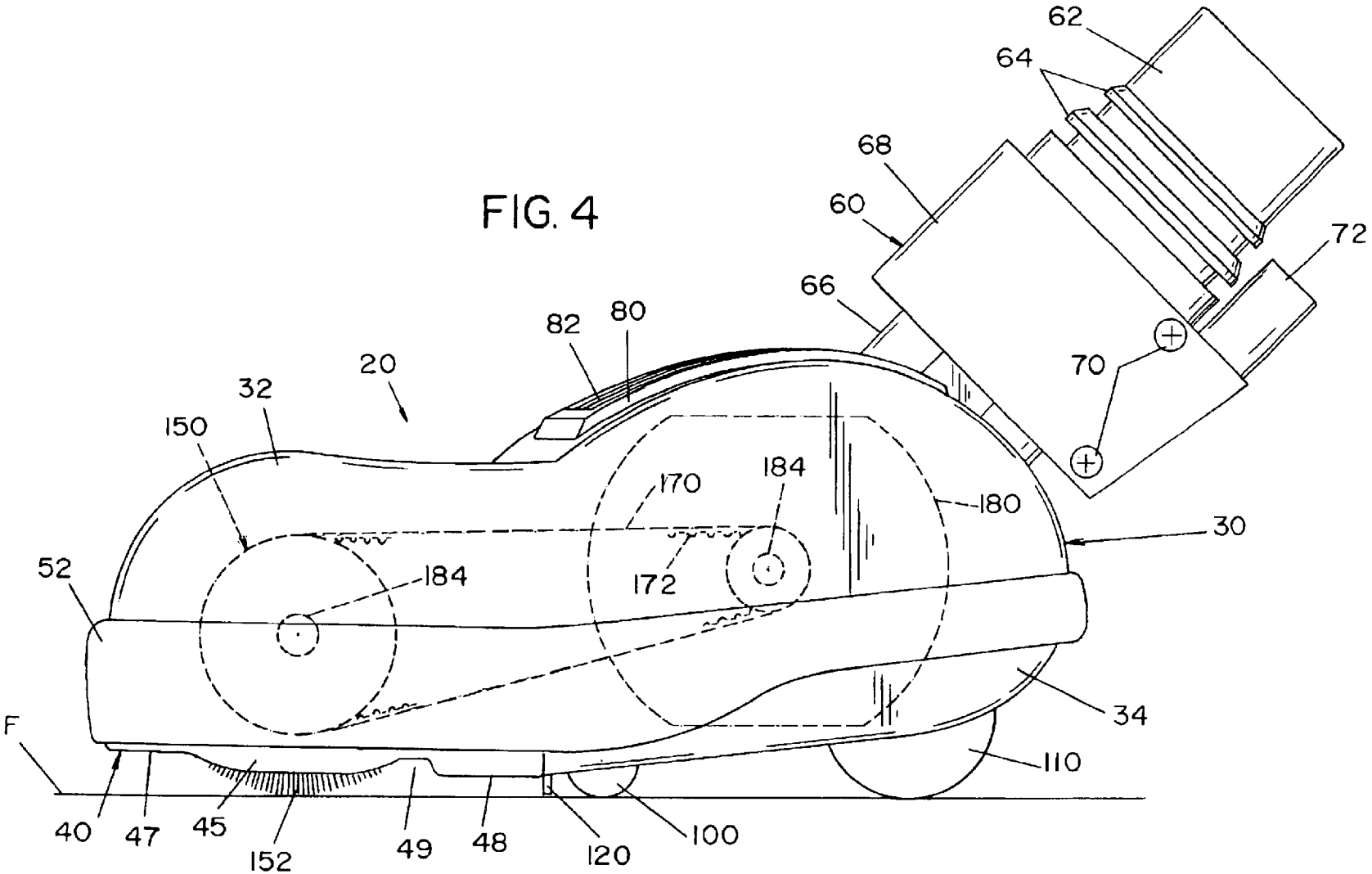
FIG. 4 is a side view of the power nozzle shown in FIG. 1.

As illustrated in FIGS. 2 and 4, the bottom portion of the housing that extends rearwardly of the dirt guard slopes upwardly to the back end of the bottom portion. The slope is substantially linear. This configuration of the bottom portion facilitates in the movement of the power nozzle over a variety of surfaces.

The bottom plate 40 includes four openings 44 that provide access to the suction opening 35 in the bottom portion of the housing. The bottom plate 40 is mounted to the bottom portion of the housing by screws 42 that are inserted through screw openings 41. The bottom plate is secured to the front end of the bottom portion of the housing by hook ledges 43. The hook ledges engage recess 37 on the bottom portion of the housing.

The bottom plate also includes three rigidity bars 46 that define openings 44 and provide structural rigidity to the bottom plate. The rigidity bars are also designed to limit access to the suction opening and inhibit or prevent large objects from being drawn completely into the suction opening during the operation of the power nozzle. The rigidity bars also facilitate in the movement of the power nozzle over a variety of surfaces.

Figure 8:
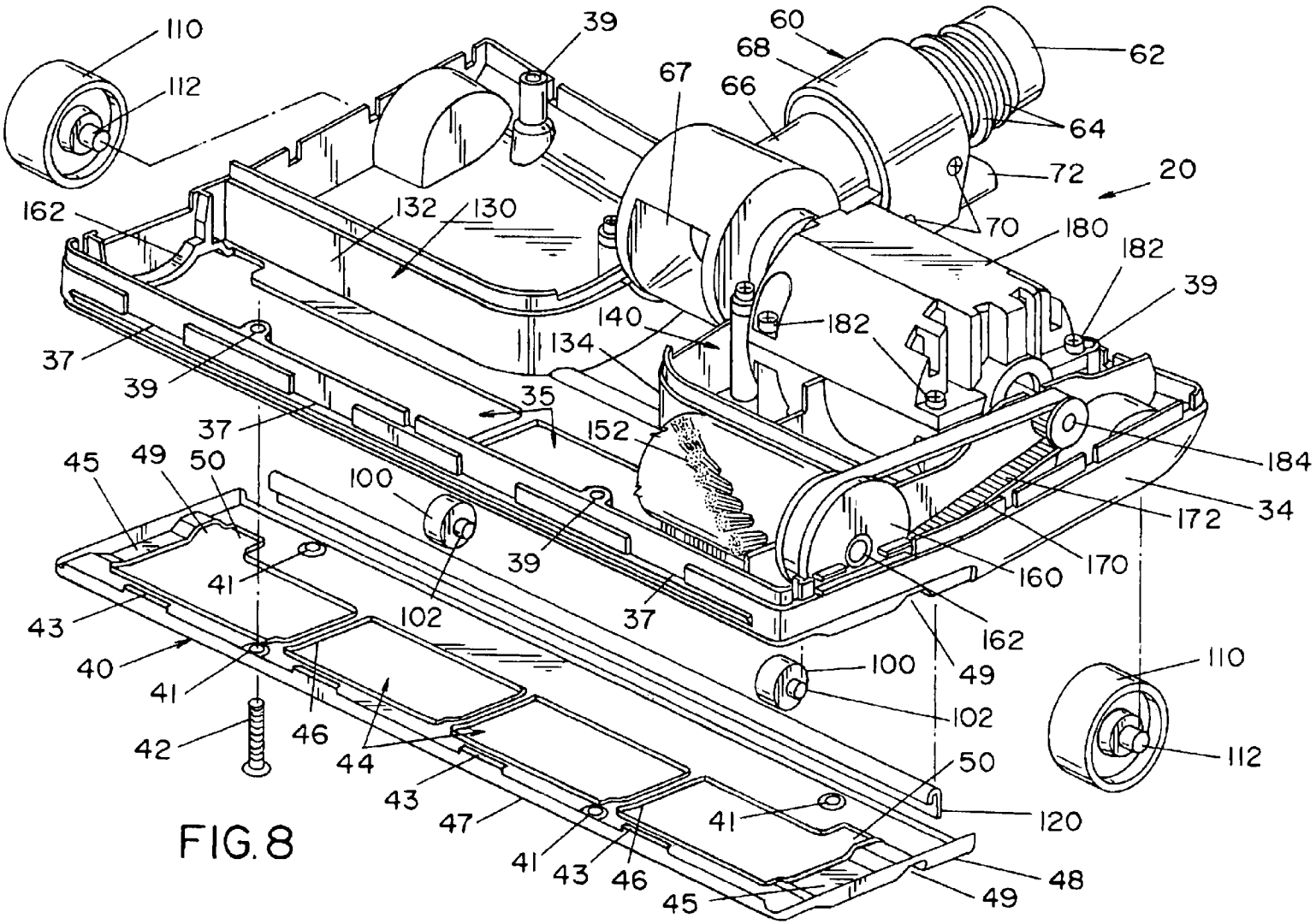
FIG. 8 is a partial exploded view of the bottom component of the power nozzle shown in FIG. 1.

The sides 45 of the bottom plate and the rigidity bars have a novel sloping configuration that is designed to improve the suction of the power nozzle. As illustrated in FIGS. 2 and 8, the sides of the bottom plate and the rigidity bars slope downwardly from the bottom portion of the housing at a point spaced from the front end of the bottom portion. The front surface 47 of the bottom plate lies in a plane substantially parallel to the front surface of the bottom portion. The downward slope of the sides and the rigidity bars is substantially linear. The sides and the rigidity bars slope downwardly only partially the length of openings 44 and then the rigidity bars level off the remaining length of openings 44 until the rigidity bars merge with the back surface 48 of the bottom plate. As illustrated in FIG. 2, the sides of the bottom plate also level off in the mid portion of openings 44 such that the bottom profile of the bottom plate is substantially the same. Prior to the sides merging with back surface 48, the sides slope upwardly to form a side recess 49 in the bottom plate. The side recess is designed to provide cleaning along the side of the power nozzle. The upward slope of the sides is substantially linear. The back surface also includes a recess 50 adjacent to the side recess to improve the amount of suction through the side recess during the operation of the power nozzle. As illustrated in FIG. 8, the bottom surface of the bottom portion of the housing has a similar configuration as the sides 45 of the bottom plate. Such a configuration facilitates in maintaining the bottom plate in the proper position on the bottom portion of the housing and also facilitates in rigidifying the bottom plate along the side regions of the bottom plate.

Referring now to FIGS. 6 and 8, the interior of the housing forms two principal compartments, namely a front compartment 130 and rear compartment 140. The front compartment includes a rotary brush 150 that is journaled in bearings 160. The bearings are positioned in bearing slots 162 located on the sides of the front compartment. One end of the bearings includes a belt groove 164 to receive a belt 170 that drives the rotary brush. The brush includes a plurality of bristle rows 152 along the length of the brush. The brush 150 and bearings 160 are removable and may be adjustable in a known manner for compensating for bristle wear and for replacing the brush drive belt 170.

As illustrated in FIG. 8, the front and rear compartments are separated by partitions 132, 134. The partitions separate the front and rear compartments to prevent dirt and other debris drawn through suction openings 35 to enter the back compartment wherein the motor 180 is located. The partitions also are designed to direct dirt and other debris to the mouth 67 of the lower extension 66. The lower extension is journaled in the bottom portion of the housing so that the lower extension can move between an upward and downward position. As illustrated in FIG. 8, the bottom portion of the housing includes several bosses 39 that are designed to receive screws 36 and 42 so that the upper and bottom portions of the housing can be connected together.

Motor 180 is mounted in the back compartment by motor screws 182. The motor includes an axle 184 that causes belt 170 to drive the rotary brush. The belt includes a plurality of ribs 172 that reduces slippage on the belt drives of the rotary brush. The motor 180 is supplied with power by an electrical cord which is plugged into a supply cord mounted on the wand W at electrical connection 72. Motor 180 located in rear compartment 140 is completely separate from front compartment 130. In this manner, the motor and rear compartment are substantially free of lint collection originating from dust laden suction air currents. Motor 180 is cooled by a self-contained fan which circulates cooling air through the motor. Such air passes into or out of the rear compartment through slots 82 in grill 80. The power nozzle unit may be provided with a headlight, not shown, to provide illumination in the front and/or sides of the power nozzle.

Referring now to FIGS. 11–14, a floor screen 190 is illustrated as being connected over the bottom plate. The floor screen includes front and back clips 192, 194 that releasably secure the floor screen to the bottom plate. The floor screen has a similar profile as the bottom plate so as to fit over the bottom plate. The floor screen includes a plurality of narrow slots 196 that are designed to inhibit or prevent smaller objects from passing into the suction opening.

Figure 3:
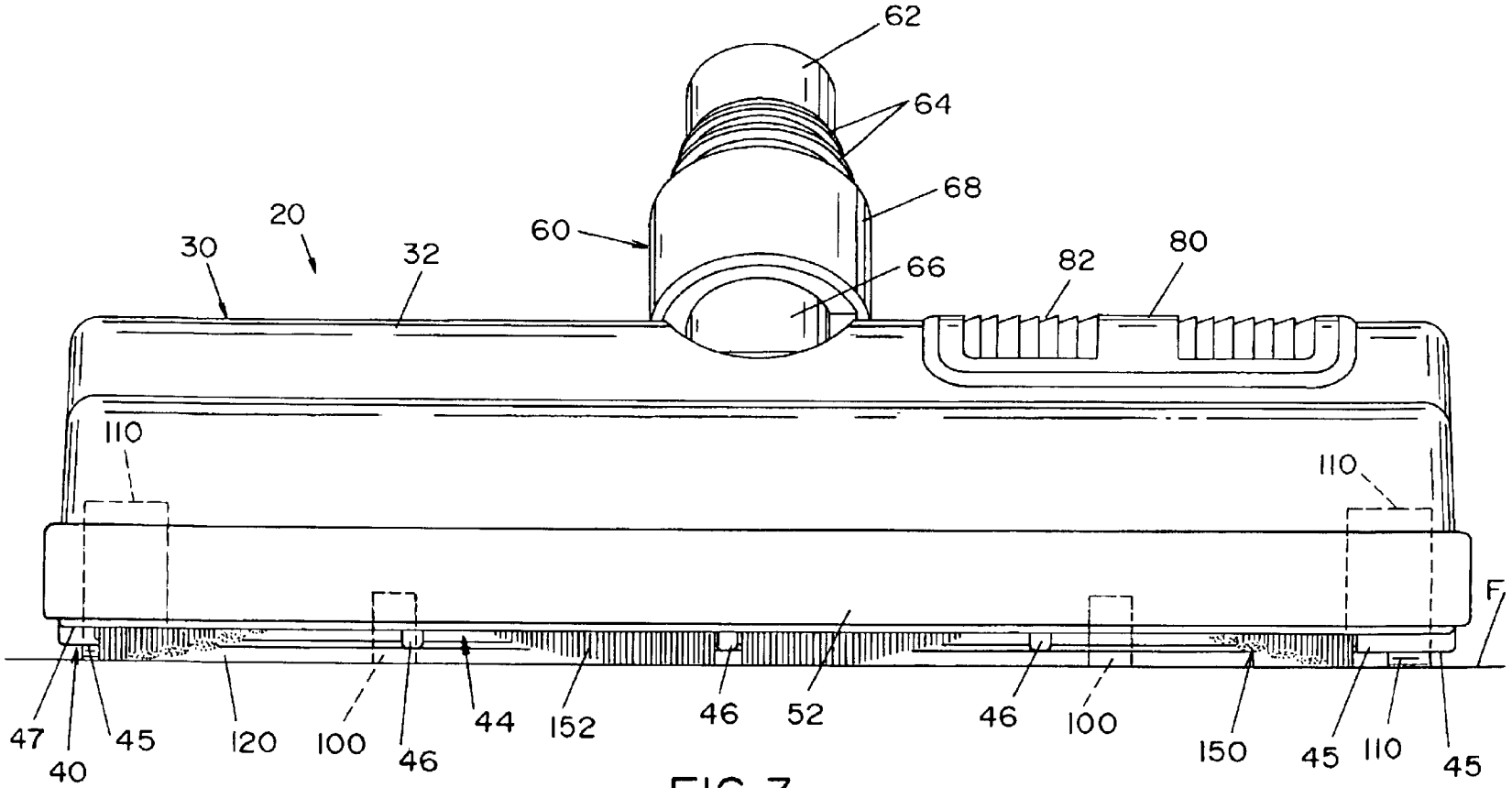
FIG. 3 is a front view of the power nozzle shown in FIG. 1.

The operation of the improved power nozzle will now be described. Referring now to FIGS. 3–5, the power nozzle is uniquely designed such that the suction openings in the power nozzle are positioned closer to a floor surface than prior power nozzle designs. As a result, increased cleaning efficiencies are obtained. As illustrated in FIG. 4, the distance between the front and lower surface of the power nozzle decreases until a point within the suction opening. This profile results in the velocity of the air being increased as this air is drawn into the suction opening, which in turn results in increased amounts of suction near and into the suction opening, and a lifting action in the front of the power nozzle. As a result, during the operation of the power nozzle, the front of the power nozzle tends to float along a floor surface F.

Figure 9:
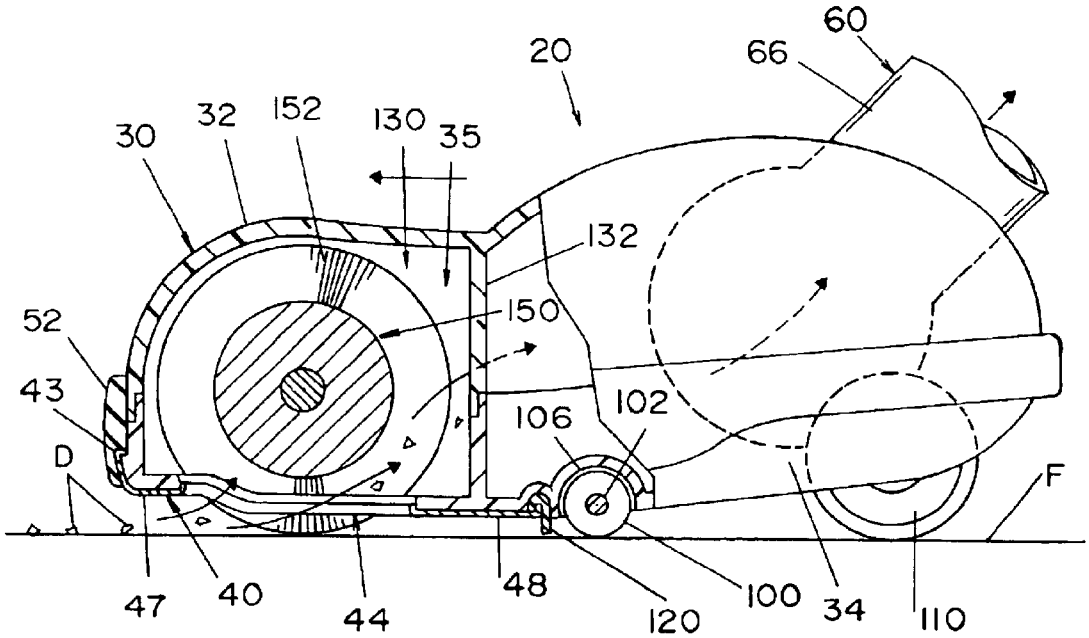
FIG. 9 is a sectional view of the side of the power nozzle in operation on a hard flat surface.

The increased amount of suction improves dirt removal from a floor surface. The floating effect at the front of the nozzle improves the ease of movement of the power nozzle over various floor surfaces. Referring now to FIG. 9, the power nozzle is illustrated as being operated over a hard floor surface such as a wood floor, tile floor, or linoleum floor. During the operation of the power nozzle over such floor surfaces, the rotating brush is typically not activated, thereby reducing the tendency of the brush to scratch such surfaces. However, the rotating brush can be activated if desired. As illustrated in FIG. 9, dirt D on floor F is drawn into the suction opening and out of the power nozzle through lower extension 66 and into the wand of the vacuum cleaner. The front and rear wheels 100, 110 are arranged such that much of the front portion of the power nozzle is positioned substantially parallel to the floor surface. The sloping profile in the bottom plate causes the front of the power nozzle to be lifted off of the floor surface, thereby creating this floating effect as the air flows through the power nozzle, as illustrated by the arrows. It has been found that due to the sloping profile of the bottom plate, the air velocities along the floor surface near the suction opening increase, which results in improved cleaning of dirt and other debris from the floor surface.

Figure 10:
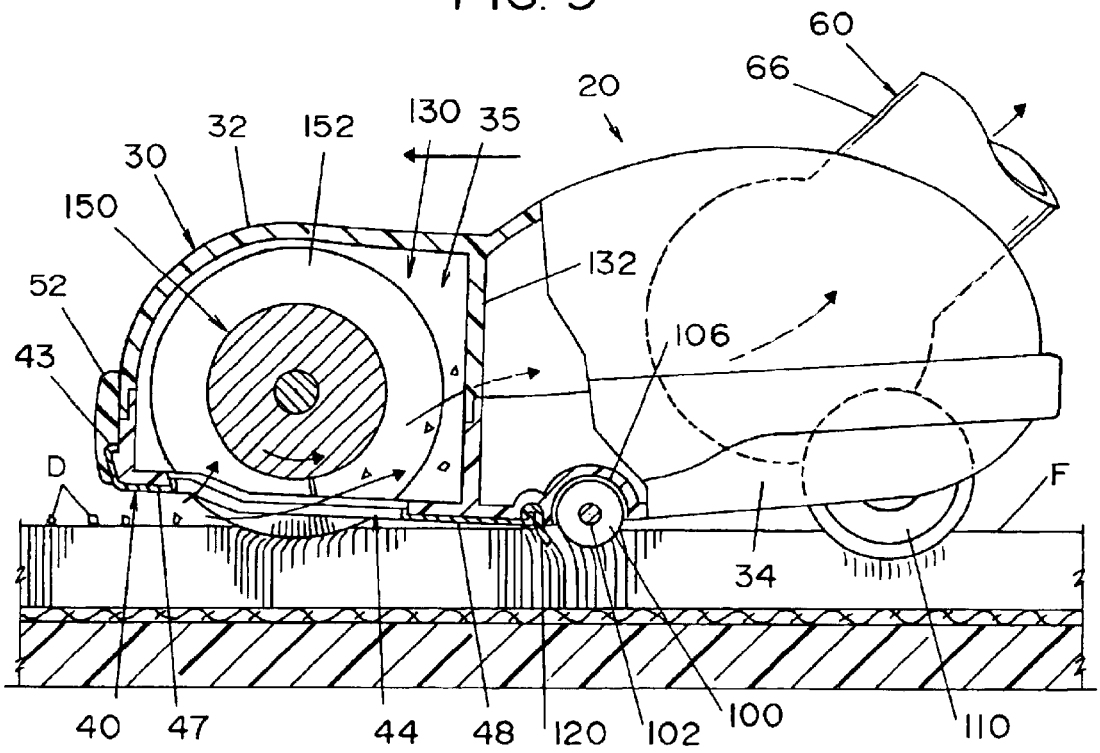
FIG. 10 is a sectional view of the side of the power nozzle in operation on a carpeted surface.
Figure 11:
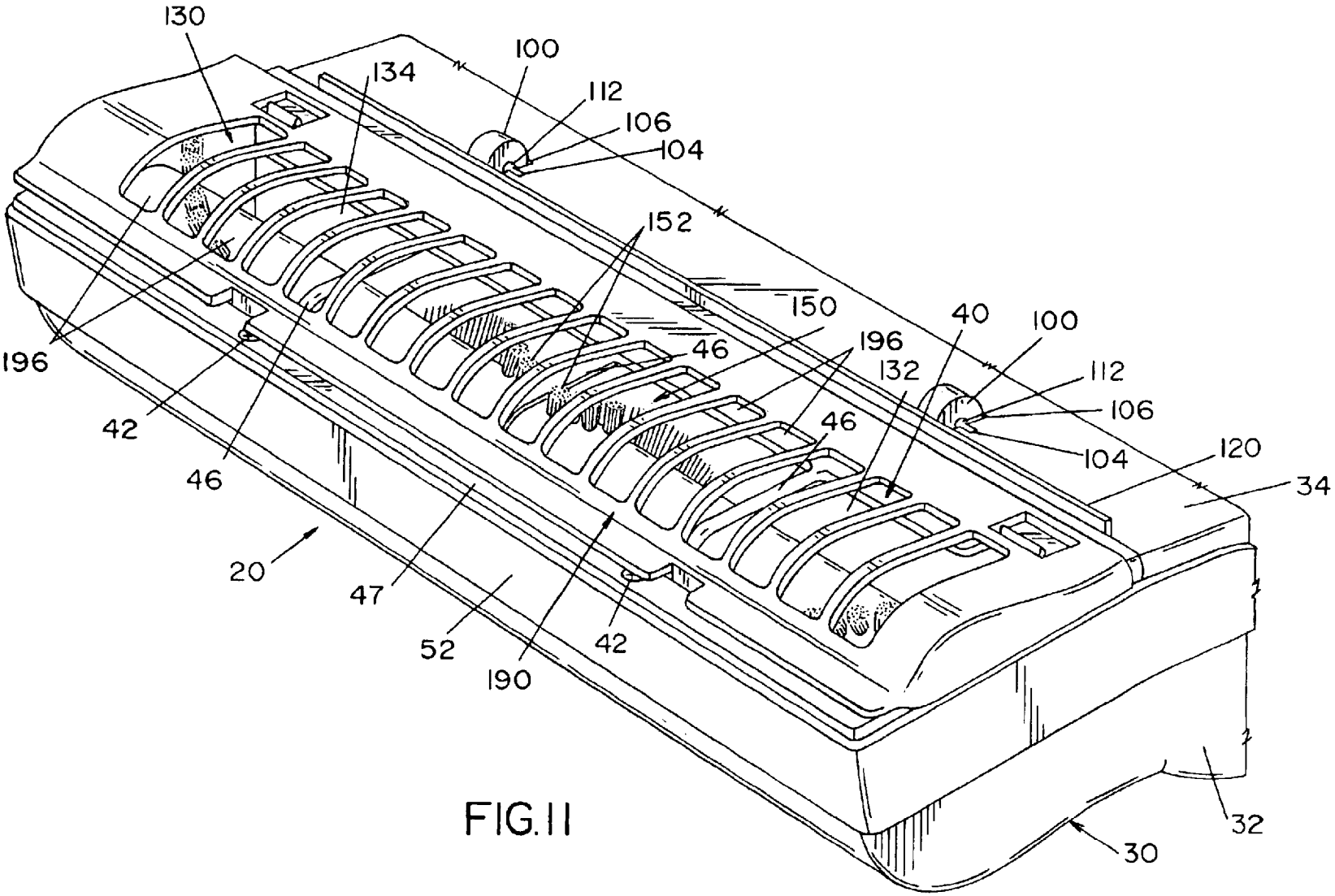
FIG. 11 is a fragmentary bottom perspective view of a modified power nozzle.

Referring now to FIG. 10, the power nozzle is illustrated as being operated over a carpeted floor surface. On such a surface, the front and rear wheels may slightly sink into the floor surface. During the operation of the power nozzle on such floor surface, the rotary brush is typically operated to agitate the floor surface, thereby facilitating in removal of dirt D from the floor surface. The sloping profile of the bottom plate on such floor surface also results in increased air velocities into the suction opening, which in turn results in improved cleaning efficiencies and the floating effect of the front of the power nozzle over the floor surface.

It has been found that this floating effect on both hard surfaces and softer surfaces facilitates in the movement of the power nozzle over such surface, thereby requiring less energy by the operator to clean such floor surface. The dust guard 120, on both hard and softer floor surfaces, inhibits or prevents the amount of dirt D which is projected rearwardly of the suction opening during the operation of the power nozzle. The flexibility of the dirt guard reduces damage to the dirt guard and to the floor surface, especially a carpeted surface wherein the dirt guard can partially sink into the floor surface as illustrated in FIG. 10. The flexibility of the dirt guard also reduces interference with the movement of the power nozzle over such floor surfaces.

Figure 12:
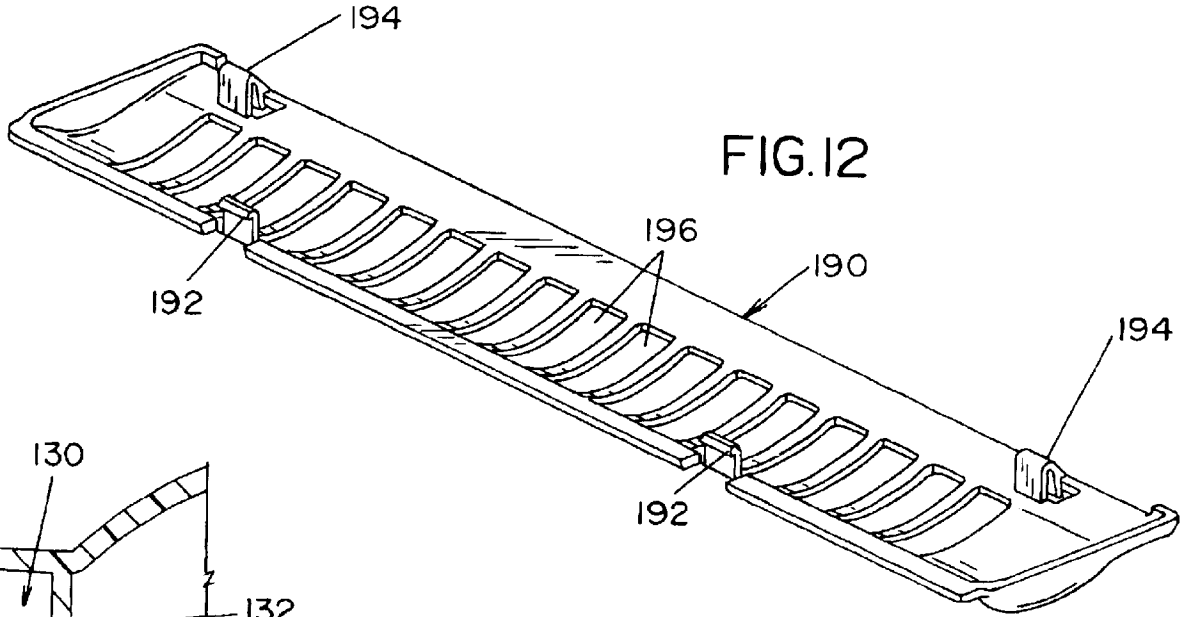
FIG. 12 is a elevation view of a screen for use on the power nozzle.
Figure 13:
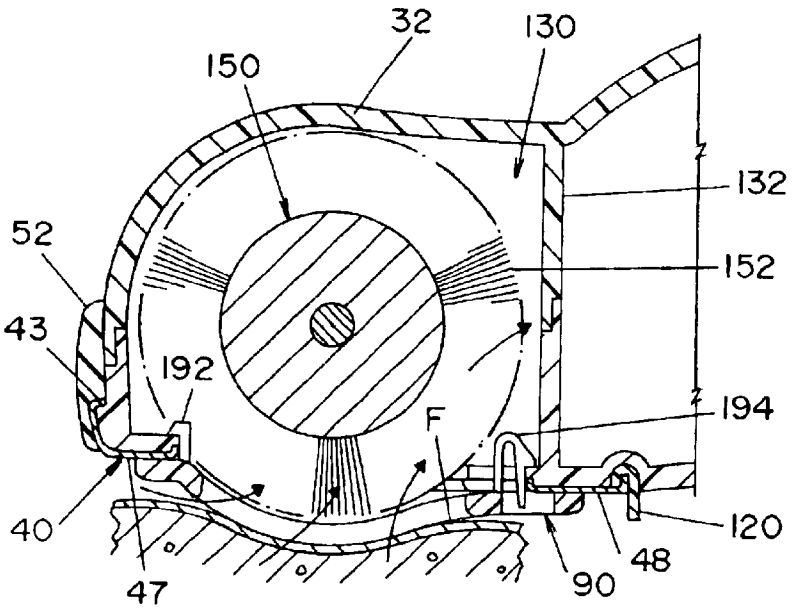
FIG. 13 is a sectional view of the front portion of the power nozzle of FIG. 11 in operation; and, FIG. 14 a section view of the front of the power nozzle of FIG. 11 in operation.
Figure 14:
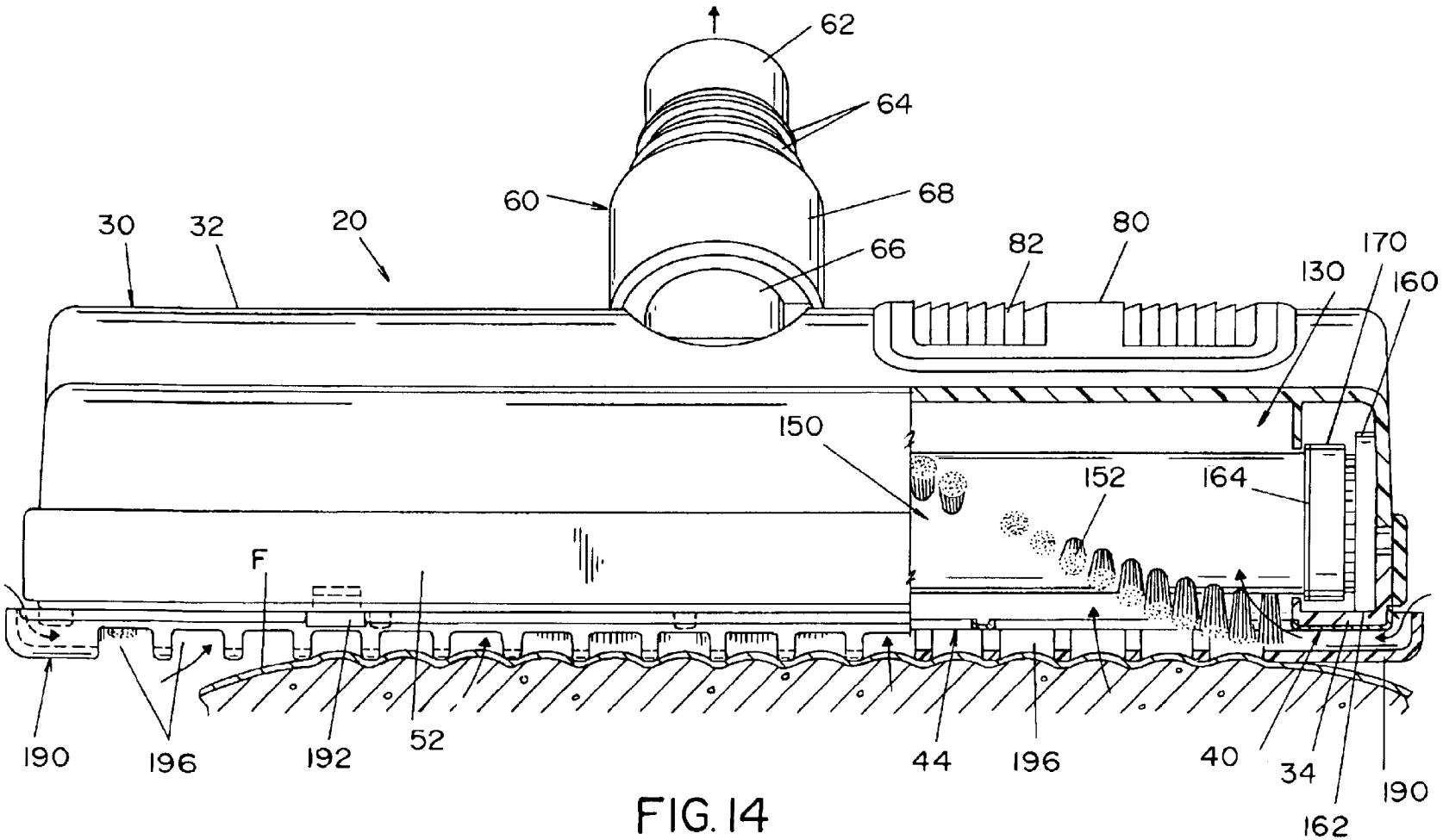

Referring now to FIGS. 13 and 14, the floor screen 190 is connected to the bottom surface of the bottom plate to further limit the size of the openings through the bottom plate and into the suction opening. Such a plate is useful when the power nozzle is used to clean area rugs, bed sheets fitted onto the bed, quilts, blankets, and the like. These types of surfaces can be drawn into the large suction openings when the floor screen is not positioned over the bottom plate. The use of the floor screen allows the power nozzle to be used on such surfaces, and further limits or prevents damage to such floor surfaces and/or to the internal components of the power nozzle. As illustrated in FIGS. 12 and 13, the floor screen includes front and back clips 192, 194 which allow the floor screen to be conveniently connected to or removed from the bottom plate, so that the floor screen can be conveniently inserted into and removed from the power nozzle when desired.

The invention has been described with reference to a preferred embodiment and alternatives thereof. It is believed that many modifications and alterations to the embodiments disclosed will readily suggest themselves to those skilled in the art upon reading and understanding the detailed description of the invention. It is intended to include all such modifications and alterations insofar as they come within the scope of the present invention.

What is claimed is:

1. In a power nozzle for use with a vacuum cleaner, said power nozzle including a housing having at least two compartments and a bottom surface, a rotary brush at least partially in a front compartment of the housing, a brush motor at least partially positioned in a back compartment of the housing, a suction opening located in the bottom surface of the housing, a set of front wheels, a set of rear wheels, and a wand opening adapted to connect to a wand; said bottom surface having a front end, a back end, and having a non-uniform planar shape between the front end and the back end, said bottom surface at least partially sloping downwardly at least between the front end of the bottom surface and the front wheels, said front set of wheels are spaced from the front end of said bottom surface a distance that is at least half the distance between the front end and back end of said bottom surface such that a position of the front set of wheels in combination with the non-uniform planar shaped bottom surface results in a floating effect, said suction opening is positioned between said front end and said front set of wheels.

2. The power nozzle as defined in claim 1, wherein said front set of wheels are unadjustable.

3. The power nozzle as defined in claim 2, wherein said rear set of wheels are unadjustable.

4. The power nozzle as defined in claim 3, wherein said a majority of downward slope is substantially linear.

5. The power nozzle as defined in claim 4, wherein a majority of said downward slope begins at a point spaced from the front end of said bottom surface.

6. The power nozzle as defined in claim 5, wherein said downward slope ends at a point spaced from the back end of the suction opening.

7. The power nozzle as defined in claim 6, said bottom surface at least partially slopes upwardly at least between the suction opening and the back end of the bottom surface.

8. The power nozzle as defined in claim 7, wherein a majority of said upward slope is substantially linear.

9. The power nozzle as defined in claim 8, wherein said upward slope begins at a point spaced from the back end of the suction opening.

10. The power nozzle as defined in claim 9, including a dirt guard positioned on and extending downwardly from said bottom surface.

11. The power nozzle as defined in claim 10, wherein said dirt guard is positioned rearwardly of said suction opening.

12. The power nozzle as defined in claim 11, including a screen connected to said suction opening.

13. The power nozzle as defined in claim 12, wherein said screen is detachably connected to said suction opening.

14. The power nozzle as defined in claim 10, wherein said dirt guard is positioned forwardly of said front set of wheels.

15. The power nozzle as defined in claim 14, including a screen connected to said suction opening.

16. The power nozzle as defined in claim 15, wherein said screen is detachably connected to said suction opening.

17. The power nozzle as defined in claim 16, including a motor filter to at least partially filter air entering said back compartment.

18. The power nozzle as defined in claim 17, including a motor filter to at least partially filter air exiting said back compartment.

19. The power nozzle as defined in claim 18, including a safety switch to deactivate said brush motor when said power nozzle is in an improper position.

20. The power nozzle as defined in claim 19, including a rubber bumper.

21. The power nozzle as defined in claim 20, including a side suction opening positioned adjacent said suction opening.

22. The power nozzle as defined in claim 3, said bottom surface at least partially slopes upwardly at least between the suction opening and the back end of the bottom surface.

23. The power nozzle as defined in claim 1, wherein said a majority of downward slope is substantially linear.

24. The power nozzle as defined in claim 1, wherein a majority of said downward slope begins at a point spaced from the front end of said bottom surface.

25. The power nozzle as defined in claim 24, wherein said downward slope ends at a point spaced from the back end of the suction opening.

26. The power nozzle as defined in claim 1, wherein said downward slope ends at a point spaced from the back end of the suction opening.

27. The power nozzle as defined in claim 1, said bottom surface at least partially slopes upwardly at least between the suction opening and the back end of the bottom surface.

28. The power nozzle as defined in claim 27, wherein a majority of said upward slope is substantially linear.

29. The power nozzle as defined in claim 27, wherein said upward slope begins at a point spaced from the back end of the suction opening.

30. The power nozzle as defined in claim 27, wherein said upward slope ends at the back end.

31. The power nozzle as defined in claim 1, including a dirt guard positioned on and extending downwardly from said bottom surface.

32. The power nozzle as defined in claim 31, wherein said dirt guard is positioned rearwardly of said suction opening.

33. The power nozzle as defined in claim 32, wherein said dirt guard is positioned forwardly of said front set of wheels.

34. The power nozzle as defined in claim 1, including a screen connected to said suction opening.

35. The power nozzle as defined in claim 34, wherein said screen is detachably connected to said suction opening.

36. The power nozzle as defined in claim 1, including a motor filter to at least partially filter air entering said back compartment.

37. The power nozzle as defined in claim 1, including a motor filter to at least partially filter air exiting said back compartment.

38. The power nozzle as defined in claim 1, including a safety switch to deactivate said brush motor when said power nozzle is in an improper position.

39. The power nozzle as defined in claim 1, including a rubber bumper.

40. The power nozzle as defined in claim 1, including a side suction opening positioned adjacent said suction opening.

41. A power nozzle for use with a vacuum cleaner comprising a housing having a bottom surface, a suction opening located in the bottom surface of the housing, and a wand connection opening adapted to receive a wand; said bottom surface having a front end, a back end, and a non-uniform planar shape between the front end and the back end, said bottom surface at least partially sloping downwardly at least between the front end of the bottom surface and a back end of the suction opening, said front set of wheels are spaced from the front end of said bottom surface a distance that is at least half the distance between the front end and back end of said bottom surface such that a position of the front set of wheels in combination with the non-uniform planar shaped bottom surface results in a floating effect, said suction opening is positioned between said front end and said front set of wheels.

42. The power nozzle as defined in claim 41, including a rotary brush at least partially positioned in said suction opening and a brush motor adapted to rotate said rotary brush.

43. The power nozzle as defined in claim 42, including a set of front wheels and a set of rear wheels.

44. The power nozzle as defined in claim 43, wherein said front set of wheels are unadjustable.

45. The power nozzle as defined in claim 44, wherein said rear set of wheels are unadjustable.

46. The power nozzle as defined in claim 45, wherein said downward slope is substantially linear.

47. The power nozzle as defined in claim 46, wherein said downward slope begins at a point spaced from the front end of said bottom surface.

48. The power nozzle as defined in claim 47, wherein said downward slope ends prior to a back end of the suction opening.

49. The power nozzle as defined in claim 48, said bottom surface at least partially slopes upwardly at least between the front end of the suction opening and the back end of said bottom surface.

50. The power nozzle as defined in claim 49, wherein said upward slope is substantially linear.

51. The power nozzle as defined in claim 49, including a dirt guard positioned on and extending downwardly from said bottom surface.

52. The power nozzle as defined in claim 51, wherein said dirt guard is positioned forwardly of a front set of wheels.

53. The power nozzle as defined in claim 52, including a screen connected to said suction opening.

54. The power nozzle as defined in claim 53, wherein said screen is detachably connected to said suction opening.

55. The power nozzle as defined in claim 54, including a motor filter to at least partially filter air cooling said brush motor.

56. The power nozzle as defined in claim 55, including a safety switch to deactivate said brush motor when said power nozzle is in an improper position.

57. The power nozzle as defined in claim 56, including a rubber bumper.

58. The power nozzle as defined in claim 57, including a side suction opening positioned adjacent said suction opening.

59. The power nozzle as defined in claim 42, including a motor filter to at least partially filter air cooling said brush motor.

60. The power nozzle as defined in claim 42, including a safety switch to deactivate said brush motor when said power nozzle is in an improper position.

61. The power nozzle as defined in claim 41, including a set of front wheels and a set of rear wheels.

62. The power nozzle as defined in claim 61, wherein said front set of wheels are unadjustable.

63. The power nozzle as defined in claim 62, including a screen connected to said suction opening.

64. The power nozzle as defined in claim 61, wherein said rear set of wheels are unadjustable.

65. The power nozzle as defined in claim 49, wherein said downward slope is substantially linear.

66. The power nozzle as defined in claim 41, wherein said downward slope begins at a point spaced from the front end of said bottom surface.

67. The power nozzle as defined in claim 41, wherein said downward slope ends prior to a back end of the suction opening.

68. The power nozzle as defined in claim 41, said bottom surface at least partially slopes upwardly at least between the front end of the suction opening and the back end of said bottom surface.

69. The power nozzle as defined in claim 68, wherein said upward slope is substantially linear.

70. The power nozzle as defined in claim 68, wherein said upward slope begins at a point spaced from a back end of the suction opening.

71. The power nozzle as defined in claim 70, wherein said upward slope ends at the back end.

72. The power nozzle as defined in claim 68, wherein said upward slope ends at the back end.

73. The power nozzle as defined in claim 41, including a dirt guard positioned on and extending downwardly from said bottom surface.

74. The power nozzle defined in claim 73, wherein said dirt guard is positioned rearwardly of said suction opening.

75. The power nozzle as defined in claim 73, wherein said dirt guard is positioned forwardly of a front set of wheels.

76. The power nozzle as defined in claim 41, including a screen connected to said suction opening.

77. The power nozzle as defined in claim 76, wherein said screen is detachably connected to said suction opening.

78. The power nozzle as defined in claim 41, including a rubber bumper.

79. The power nozzle as defined in claim 41, including a side suction opening positioned adjacent said suction opening.

* * * * *